US007426459B2

(12) United States Patent
Huang

(10) Patent No.: US 7,426,459 B2
(45) **Date of Patent: *Sep. 16, 2008**

(54) METHODS FOR DESIGNING SINGLE CONE BITS AND BITS MADE USING THE METHODS

(75) Inventor: Sujian J. Huang, Beijing (CN)

(73) Assignee: Smith International, Inc., Houston, TX (US)

( * ) Notice: Subject to any disclaimer, the term of this patent is extended or adjusted under 35 U.S.C. 154(b) by 237 days.

This patent is subject to a terminal disclaimer.

(21) Appl. No.: 11/009,972

(22) Filed: Dec. 10, 2004

(65) Prior Publication Data

US 2005/0165592 A1 Jul. 28, 2005

Related U.S. Application Data

(63) Continuation-in-part of application No. 09/635,116, filed on Aug. 9, 2000, now Pat. No. 6,873,947, which is a continuation of application No. 09/524,088, filed on Mar. 13, 2000, now Pat. No. 6,516,293.

(51) Int. Cl.
*G06G 7/48* (2006.01)

(52) U.S. Cl. ..... 703/7; 703/1; 175/40

(58) Field of Classification Search ..... 703/1, 703/7, 10; 175/39, 40, 57; 475/235; 367/75
See application file for complete search history.

(56) References Cited

U.S. PATENT DOCUMENTS

| | | | | |
|---|---|---|---|---|
| 4,408,671 | A | 10/1983 | Munson | |
| 4,815,342 | A | 3/1989 | Brett et al. | |
| 5,144,591 | A * | 9/1992 | Hardage | 367/75 |
| 5,787,022 | A | 7/1998 | Tibbitts et al. | |
| 5,864,058 | A | 1/1999 | Chen | |
| 5,868,213 | A | 2/1999 | Cisneros et al. | |
| 5,950,747 | A | 9/1999 | Tibbitts et al. | |
| 6,021,377 | A | 2/2000 | Dubinsky et al. | |
| 6,095,262 | A | 8/2000 | Chen | |
| 6,213,225 | B1 | 4/2001 | Chen | |
| 6,241,034 | B1 | 6/2001 | Steinke et al. | |

(Continued)

FOREIGN PATENT DOCUMENTS

| | | |
|---|---|---|
| SU | 933932 | 6/1982 |

(Continued)

OTHER PUBLICATIONS

Shapiro et al. H.D. Microcomputing Technology for Drilling, Proceedings of the 1986 Workshop on Applied Computing SAC '86, Oct. 1986, pp. 13-20.*

(Continued)

*Primary Examiner*—Russell Frejd
(74) *Attorney, Agent, or Firm*—Osha Liang, LLP

(57) ABSTRACT

Methods of designing a single cone roller cone bit, and bits made using those methods are disclosed. In particular, methods of graphically displaying a single cone roller cone bit interacting with a formation is shown. In one method, a value of at least one design parameter for the single cone roller cone drill bit according to the graphical display is adjusted. The simulating, displaying and adjusting to change a simulated performance of the single cone roller cone drill bit may be repeated as necessary.

16 Claims, 20 Drawing Sheets

U.S. PATENT DOCUMENTS

| | | | | |
|---|---|---|---|---|
| 6,261,202 | B1 * | 7/2001 | Forrest et al. | 475/235 |
| 6,290,006 | B1 | 9/2001 | Crawford | |
| 6,349,595 | B1 | 2/2002 | Civolani et al. | |
| 6,401,839 | B1 | 6/2002 | Chen | |
| 6,412,577 | B1 | 7/2002 | Chen | |
| 6,516,293 | B1 | 2/2003 | Huang et al. | |
| 2004/0230413 | A1 * | 11/2004 | Chen | 703/10 |

FOREIGN PATENT DOCUMENTS

| | | | |
|---|---|---|---|
| SU | 1461855 | A1 | 2/1989 |
| SU | 1654515 | A1 | 7/1991 |
| SU | 1691497 | A1 | 11/1991 |
| WO | WO-00/12859 | | 3/2000 |
| WO | WO-00/12860 | | 3/2000 |

OTHER PUBLICATIONS

Certification and Notarization dated Nov. 12, 2003 from Universe Technical Translation, 1 page.
Translation of Description of Invention No. 933932 dated Jun. 7, 1982 (2 pages).
D. Ma, et al. "Dynamics of Roller Cone Bits", Journal of Energy Resources Technology, Dec. 1985, vol. 107 (pp. 543-548).
D. Ma, et al. "A New Way to Characterize the Gouging-Scraping Action of Roller Cone Bits", Society of Petroleum Engineers, 1989 (24 pgs.).
Boris L. Steklianov, "Increasing the Efficiency of Rock-Cutting Tools on the Basis of Comparative Analysis of the Kinetic Characteristics of Their Cutting Structure"; NDERI, 1990 (24 pages).
Robert L. McIntyre, "Surface Mine Rotary Drilling", Smith-Gruner (3 pages), 1985.
RockBit International, "System Designed to Speed Continuous Coring Operation", (4 pages), date unknown.
RockBit International, "If You've Ever Doubted RBI's Ability to Drill at a Lower Cost Per Foot . . . Ask the Folks Drilling This Well", (4 pages), date unknown.
RockBit International, "The Leader in High-Speed Drill Bit Technology" (24 pages), date unknown.
Sandvik Rock Bits, "Sandvik in the World of Oil and Gas" (8 pages), date unknown.
B. L. Steklyanov, et al.; "Improving the Effectiveness of Drilling Tools"; KhM-3 Oil Industry Machine Building; (1991) pp. 1-35.
Dekun Ma, et al.; "The Computer Simulation of the Interaction Between Roller Bit and Rock"; International Meeting on Petroleum Engineering; PR China; Nov. 14-17, 1995; pp. 309-317.
Ma Dekun, et al., "The Operational Mechanics of The Rock Bit", Petroleum Industry Press, 1996, pp. 1-243.
Society of Petroleum Engineers Paper No. 56439, "Field Investigation of the Effects of Stick-Slip, Lateral, and Whirl Vibrations on Roller Cone Bit Performance", S.L. Chen, et al., presented Oct. 3-6, 1999, (10 pages).
Society of Petroleum Engineers Paper No. 71053, "Development and Application of a New Roller Cone Bit with Optimized Tooth Orientation", S. L. Chen, et al., presented May 21-23, 2001 (15 pages).
Society of Petroleum Engineers Paper No. 71393, "Development and Field Applications of Roller Cone Bits with Balanced Cutting Structure", S. L. Chen, et al., presented Sep. 30-Oct. 3, 2001 (11 pages).
Hancke, et al., G.P. A Controll System for Optimizing Deep Hole Drilling Conditions, IECON 1991 International Conference on Industrial Electronics, Control and Instrumentation, 1991, pp. 2279-2284.
Ertunc, et al., H. M. Real Time Monitoring of Tool Wear Using Multiple Modeling Method, IEEE International Electric Machines and Drives Conference, IEMDC 2001, pp. 687-691.
Hancke, G. P. The Effective Control of a Deep Hole Diamond Drill, Conference Record of the IEEE Industry Applications Society Annual Meeting, 1991, pp. 1200-1205.
Howie, et al., W. L. A Smart Bolter for Improving Entry Stability, Conference Record of the IEEE Industry Applications Society Annual Meeting, 1989, pp. 1556-1564.
Translation of Description of Invention No. 295857 dated Feb. 12, 1971 (2 pages).
Translation of Description of Invention No. 398733 dated Sep. 27, 1973 (2 pages).
Translation of Description of Invention No. 420749 dated Mar. 25, 1974 (2 pages).
Translation of Description of Invention No. 229371 dated Oct. 23, 1968 (1 page).
Translation of Description of Invention No. 436147 dated Jul 15, 1974 (2 pages).
Translation of Description of Invention No. 469801 dated May 5, 1975 (2 pages).
Translation of Description of Invention No. 515867 dated May 30, 1976 (2 pages).
Palashchenko, et al.; "Study of Roller Cone Bits With Disk Rink Inserts"; Neftyanoye Khozyaystvo (Oil Industry), Issue 11, 1987 (4 pages).
Rudolf C.O. Pessier, et al. "Rolling Cone Bits With Novel Gauge Cutting Structure" Drill Faster, More Efficiently, SPE 30473; 1995, pp. 241-250.
M. C. Sheppard, et al. "The Forces at the Teeth of a Drilling Rollercone bit: Theory and Experiment", SPE 18042; 1988 (pp. 253-260).
"Longer Useful Lives for Roller Bits Cuts Sharply Into Drilling Costs" S.A. Mining & Engineering Journal, Mar. 1979, (pp. 39-43).
Johannes D. Brakel, "Prediction of Wellbore Trajectory Considering Bottom Hole Assembly and Drill Bit Dynamics", The University of Tulsa, (66 pages), 1986.
R. K. Dropek, et al. "A Study to Determine Roller Cone Cutter Offset Effects at Various Drilling Depths", ASME vol. 78-Pet-23, (10 pages), date unknown.
Doodnath Ramsunder "Bit Deviation Forces Due to Rock-Bit Interaction" University of Tulsa, (66 pages), 1976.
E. I. Umez-Eronini, "Rotary Drill Bit/Rock Model with Cutter Offset" Journal of Energy Resources Technology, vol. 105, Sep. 1983 (3 pages).
D. Ma, et al. "Kinematics of the Cone Bit" SPE 10563; Jun. 1985 (30 pages).

* cited by examiner

METHODS FOR DESIGNING SINGLE CONE BITS AND BITS MADE USING THE METHODS

CROSS-REFERENCE TO RELATED APPLICATIONS

This application is a continuation-in-part of, and claims the benefit, pursuant to 35 U.S.C. §120, to U.S. patent application Ser. No. 09/635,116, now U.S. Pat. No. 6,873,947, which is a continuation of U.S. patent application Ser. No. 09/524,088, now U.S. Pat. No. 6,516,293, filed on Mar. 13, 2000. These applications, now patents, are expressly incorporated by reference in their entireties.

BACKGROUND OF INVENTION

1. Field of the Invention

The invention relates generally to single cone roller cone drill bits, and more specifically to simulating the drilling performance of single cone roller cone bits. In particular, the invention relates to methods for generating a visual representation of a single cone roller cone bit drilling earth formations, methods for designing single cone roller cone bits, and methods for optimizing the drilling performance of a single cone roller cone bit design.

2. Background Art

Roller cone bits are one type of drill bit used to drill wellbores through earth formations. Roller cone bits include a bit body adapted to be coupled to a drilling tool assembly or "drill string" which rotates the bit as it is pressed axially into the formations being drilled. FIG. 1 shows one example of a conventional drilling system drilling an earth formation. The drilling system includes a drilling rig 10 used to turn a drill string 12 which extends downward into a well bore 14.

The bit body includes one or more legs, each having thereon a bearing journal. The most commonly used types of roller cone drill bits include three such legs and bearing journals. A roller cone is rotatably mounted to each bearing journal. During drilling, the roller cones rotate about the respective journals while the bit is rotated. The roller cones include a number of cutting elements, which may be press fit inserts made from tungsten carbide and other materials, or may be milled steel teeth.

The cutting elements engage the formation in a combination of crushing, gouging, and scraping or shearing action which removes small segments of the formation being drilled. The inserts on a cone of a three-cone bit are generally classified as inner-row insert and gage-row inserts. Inner row inserts engage the bore hole bottom, but not the well bore wall. Gage-row inserts engage the well bore wall and sometimes a small outer ring portion of the bore hole bottom. The direction of motion of inserts engaging the rock on a two or three-cone bit is generally in one direction or a very small limited range of direction, i.e., 10 degrees or less.

One particular type of roller cone drill bit includes only one leg, bearing journal, and roller cone rotatably attached thereto. The drilled hole and the longitudinal axis of this type of bit are generally concentric. This type of drill bit has generally been preferred for drilling applications when the diameter of the hole being drilled is small (less than about 4 to 6 inches [10 to 15 cm]) because the bearing structure can be larger relative to the diameter of the drilled hole when the bit only has one concentric roller cone. This is in contrast to the typical three-cone rock bit, in which each journal must be smaller relative to the drilled hole diameter.

An important performance aspect of any drill bit is its ability to drill a wellbore having the full nominal diameter of the drill bit from the time the bit is first used to the time the cutting elements are worn to the point that the bit must be replaced. This a particular problem for single cone bits because of the motion (trajectory) of the cutting elements as they drill the wellbore. The inserts on a single cone bit go through large changes in their direction of motion, typically anywhere from 180 to 360 degrees. Such changes require special consideration in design. The inserts on a single cone bit undergo as much as an order of magnitude more shear than do the inserts on a conventional two or three cone bit. Such amounts of shear become apparent when looking at the bottomhole patterns of each type of bit.

A general structure for a single cone rock bit is shown in cut away view in FIG. 2. The bit includes a bit body 1 made of steel or other high strength material. The bit body 1 includes a coupling 4 at one end thereof that is adapted to join the bit body 1 to a drill string (not shown) for rotating the bit during drilling. The bit body 1 may include gage protection pads 2 at circumferentially spaced apart positions about the bit body 1. The gage protection pads 2 may include gage protection inserts 3 in some embodiments. The gage protection pads 2, if used, extend to a drill diameter 18 of the bit. Other embodiments of a bit according to the invention may not have gage pads.

The other end of the bit body 1 includes a bearing journal 1A to which a single, generally hemispherically shaped roller cone 6 is rotatably mounted. In some embodiments, the cone 6 may be locked onto the journal 1A by retaining or locking balls 1B disposed in corresponding grooves or races on the outer surface of the journal 1A and on the interior surface of the cone 6. Locking balls are only one example of a mechanism to retain the cone 6 on the journal 1A.

The cone 6 is formed from steel or other high strength material, and may in some embodiments be covered about its exterior surface with hardfacing or similar coating intended to reduce abrasive wear of the cone 6. In some embodiments, the drill bit will include a seal 8 disposed between cone 6 and journal 1A to exclude fluid and debris from entering the space between the inside of the cone 6 and the journal 1A. Such seals are well known in the art. The journal 1A and cone 6 are arranged so that the cone 6 is roughly concentric with the longitudinal axis 11 of the bit body 1. The journal 1A depends from the bit body 1 such that it defines an angle $\alpha$ between the rotational axis 9 of the journal 1A and the rotational axis of the bit 11. The size of this angle $\alpha$ will depend on factors such as the nature of the earth formations being drilled by the bit.

The cone 6 includes a plurality of cutting elements thereon at selected positions, which may be, for example, inserts 5 generally interference fit into corresponding sockets (not shown separately) in the outer surface of the cone 6. The inserts 5 may be made from tungsten carbide, other metal carbide, or other hard materials known in the art for making drill bit inserts. The inserts 5 may also be made from polycrystalline diamond, boron nitride or other super hard material known in the art, or combinations of hard and super hard materials known in the art.

One significant factor to be considered in the design of a single cone roller cone drill bit is its ability to avoid "tracking," a situation in which cutting elements traverse the same subset of the cross-section of the drilled hole, leaving other areas of the cross-section undrilled. Tracking reduces drilling performance because the hole bottom is not evenly drilled. Avoiding tracking in single cone rock bits is particularly difficult because of the very complex motion of the individual cutting elements on the roller cone as the bit drills earth formations.

Significant expense is involved in the design and manufacture of drill bits. Therefore, having accurate models for simulating and analyzing the drilling characteristics of bits can greatly reduce the cost associated with manufacturing drill bits for testing and analysis purposes. For this reason, several models have been developed and employed for the analysis and design of 2, 3, and 4 roller cone bits. See, for example, U.S. Pat. Nos. 6,213,225, 6,095,262, 6,412,577, and 6,401,839. In addition, U.S. Pat. No. 6,516,293 discloses a simulation method for multiple cone bits, which is assigned to the assignee of the instant application, and is incorporated by reference in its entirety.

The simulation model disclosed in the '293 patent is particularly useful in that it provides a means for analyzing the forces acting on the individual cutting elements on the bit, thereby leading to the design of, for example, faster drilling bits and designs having optimal spacing and placing of cutting elements on such bits. By analyzing forces on the individual cutting elements of a bit prior to making the bit, it is possible to avoid expensive trial and error designing of bit configurations that are effective and long lasting.

However, modeling single roller cone bits is significantly more complex than multiple roller cone bits because of the complex motion (explained above) of the individual cutting elements on the single roller cone as the bit drills the earth formation.

What is needed are methods to simulate and optimize performance of single cone roller cone bits drilling earth formations. Simulation of single cone roller cone bits would enable analyzing the drilling characteristics of proposed bit designs and permit studying the effect of bit design parameter changes on the drilling characteristics of a bit. Such analysis and study would enable the optimization of single cone roller cone drill bit designs to produce bits which exhibit desirable drilling characteristics and longevity. Similarly, the ability to simulate single cone roller cone bit performance would enable studying the effects of altering the drilling parameters on the drilling performance of a given bit design. Such analysis would enable the optimization of drilling parameters for purposes of maximizing the drilling performance of a given bit.

SUMMARY OF INVENTION

In one aspect, embodiments described herein provide a method for designing a single cone roller cone drill bit, the method including simulating the single cone roller cone drill bit drilling in an earth formation and graphically displaying at least a portion of the simulating.

Other aspects and advantages of the invention will be apparent from the following description and the appended claims.

DETAILED DESCRIPTION

In one aspect, the present invention relates to a method of simulating the performance of a single cone roller cone bit. A single cone bit creates multiple grooves laid out in substantially hemispherically-projected hypotrochoids, a configuration similar to ink paths generated by drawing instruments in a toy sold under the trademark SPIROGRAPH by Tonka Corp., Minnetonka, Minn. 55343. The "grooves" are created by the shearing action of the cutting elements on the single cone bit. A two or three cone bit, in contrast, generates a series of individual craters or indentations. Shearing rock to fail it will typically cause more wear on an insert than indenting an insert to compressively fail rock. Therefore, the inserts on a single cone bit wear faster than the inserts on a two or three cone bit. As the cutting elements on a single cone bit wear, therefore, the drilled hole diameter reduces correspondingly.

Thus, the motion of the inserts on a single cone roller cone bit is much more complex than that of a two, three, or four cone bit. In one embodiment, the motion (or trajectory) of the inserts may be approximated by a series of mathematical expressions. In an ideal case, the motion of the inserts may be thought of as a hypotrochoid, where the parametric equations are:

$$x = (a-b)\cos t + h\cos\left(\frac{a-b}{b}t\right) \tag{1}$$

$$y = (a-b)\sin t - h\sin\left(\frac{a-b}{b}t\right), \tag{2}$$

Special cases of the hypotrochoid includes the hypocycloid with h=b, the ellipse with a=2b, and the rose with:

$$a = \frac{2nh}{n+1} \tag{3}$$

$$b = \frac{(n-1)h}{n+1}. \tag{4}$$

The arc length (s(t)), curvature (κ(t)), and tangential angle ((ϕ(t)) are:

$$s(t) = 2|(a-b)(b-h)|E\left(\frac{at}{2b^1}\ \frac{2i\sqrt{bh}}{|b-h|}\right) \tag{5}$$

$$\kappa(t) = \frac{b^3 - (a-b)h^2 + (a-2b)bh\cos\left(\frac{at}{b}\right)}{|a-b|\left[b^2 + h^2 - 2bh\cos\left(\frac{at}{b}\right)\right]^{3/2}} \tag{6}$$

$$\phi(t) = t\left(1 - \frac{a}{2b}\right) + \cot^{-1}\left[\frac{b-h}{b+h}\cot\left(\frac{at}{2b}\right)\right], \tag{7}$$

where E(x,k) is an incomplete elliptic integral of the second kind.

The motion of any individual insert is partially dependent on the cone speed to bit speed rotation ratio. Unlike multiple cone bits, which typically have a value for this ratio of between 1.1 to 1.4, single cone bits have a ratio of 0.4 to 0.7. Therefore, in some embodiments of the present invention, the motion of the inserts depends on this ratio.

In one embodiment of the invention, the cone speed to bit speed rotation ratio may be experimentally determined by attaching sensors to a test bit. In other embodiments, however, by using kinematic equations known to those having ordinary skill in the art, the cone speed/bit speed ratio may be mathematically determined.

Figure 1:
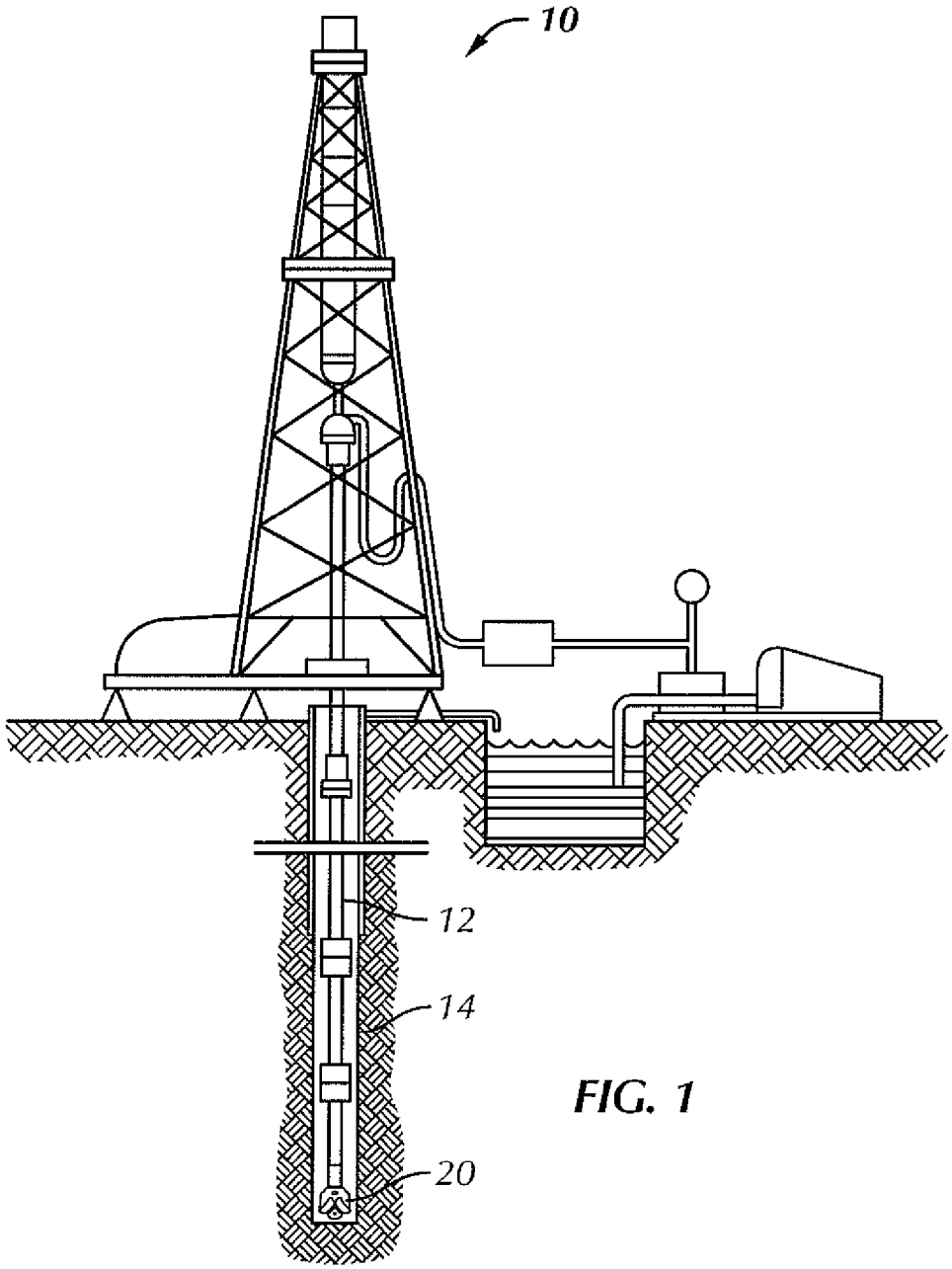
FIG. 1 shows a schematic diagram of a drilling system for drilling earth formations having a drill string attached at one end to a roller cone drill bit.
Figure 2:
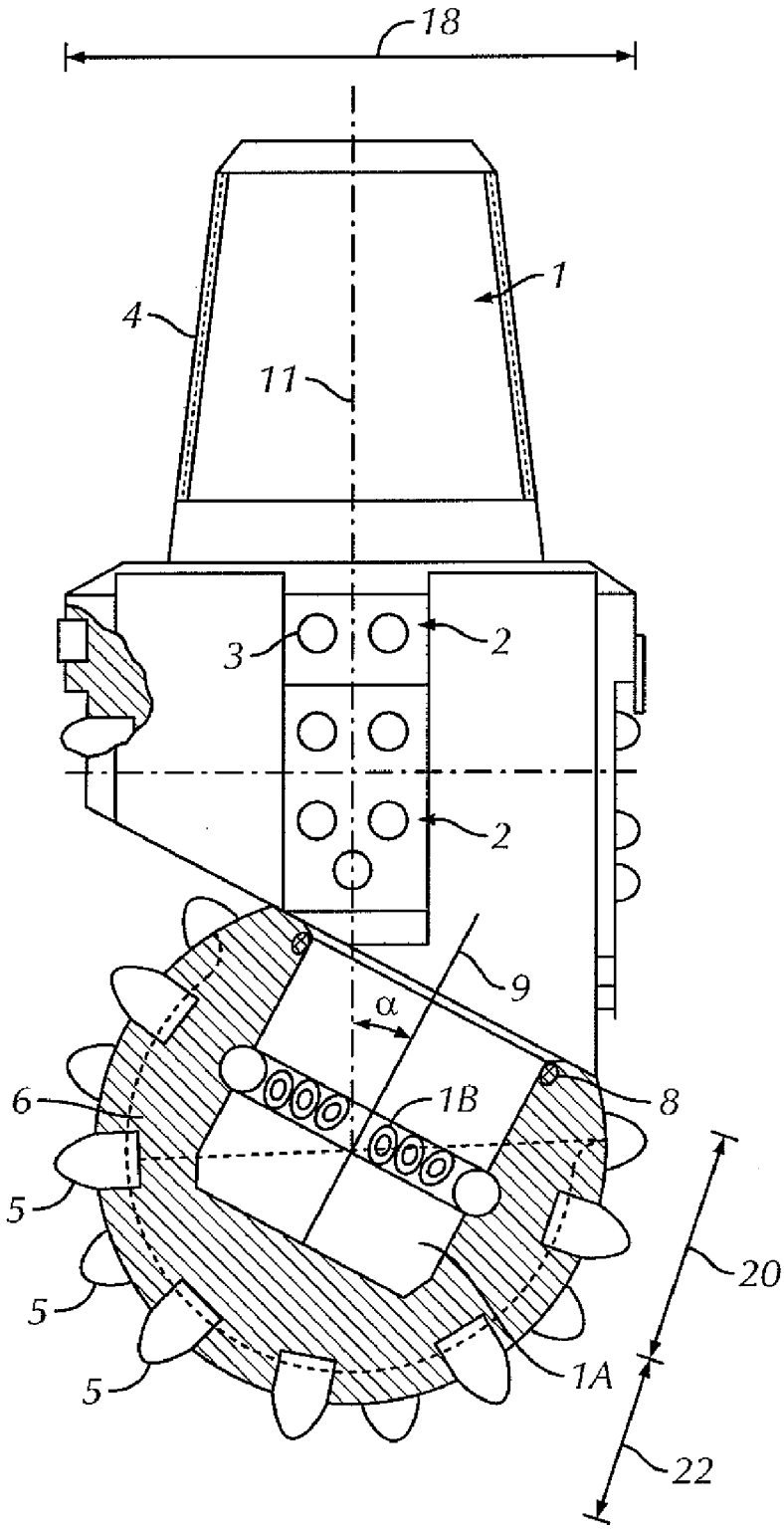
FIG. 2 shows a perspective view of a roller cone drill bit.
Figure 3A:
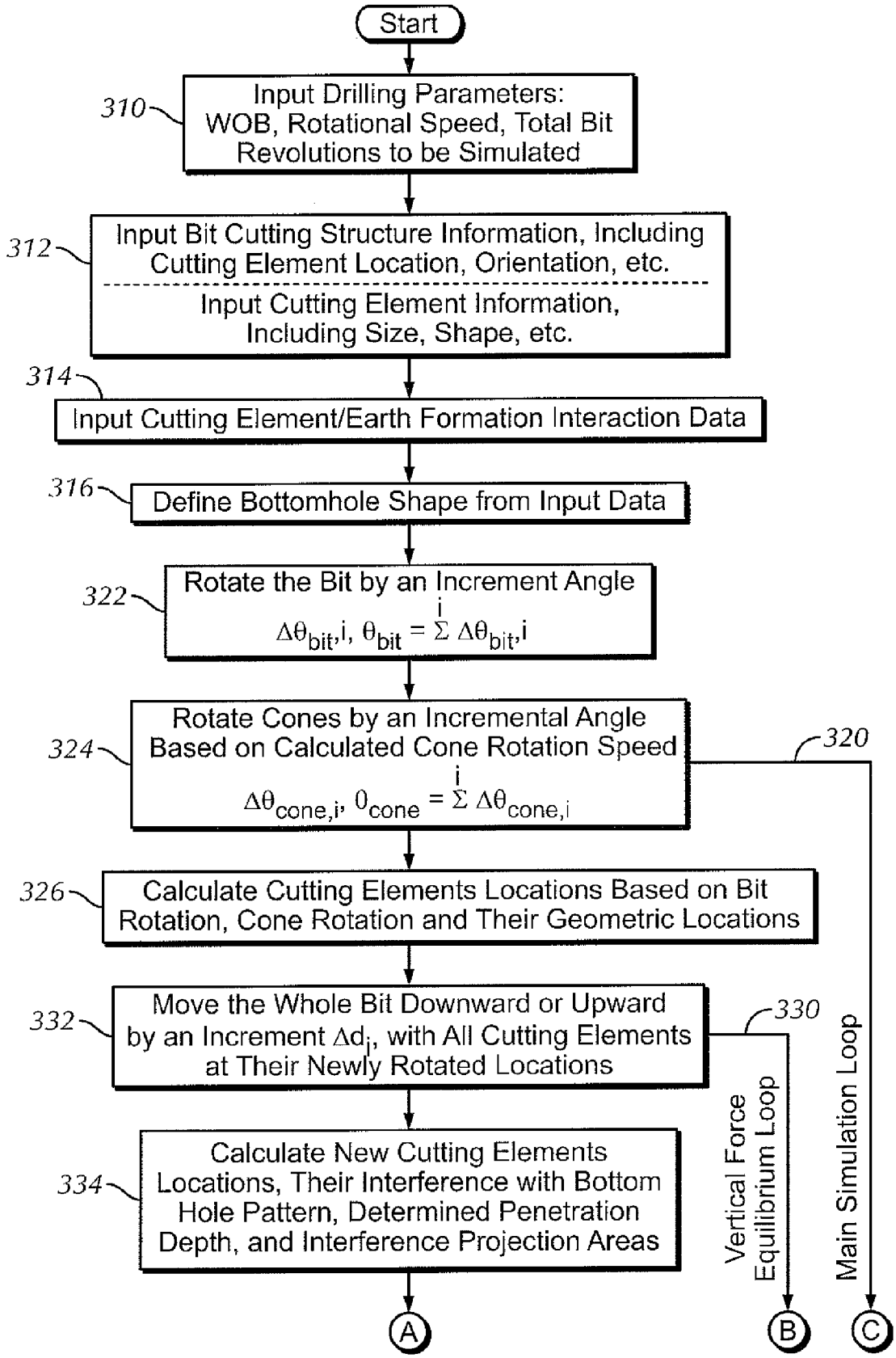
FIG. 3A and FIG. 3B show a flowchart of an embodiment of the invention for generating a visual representation of a roller cone bit drilling earth formations.
Figure 3B:
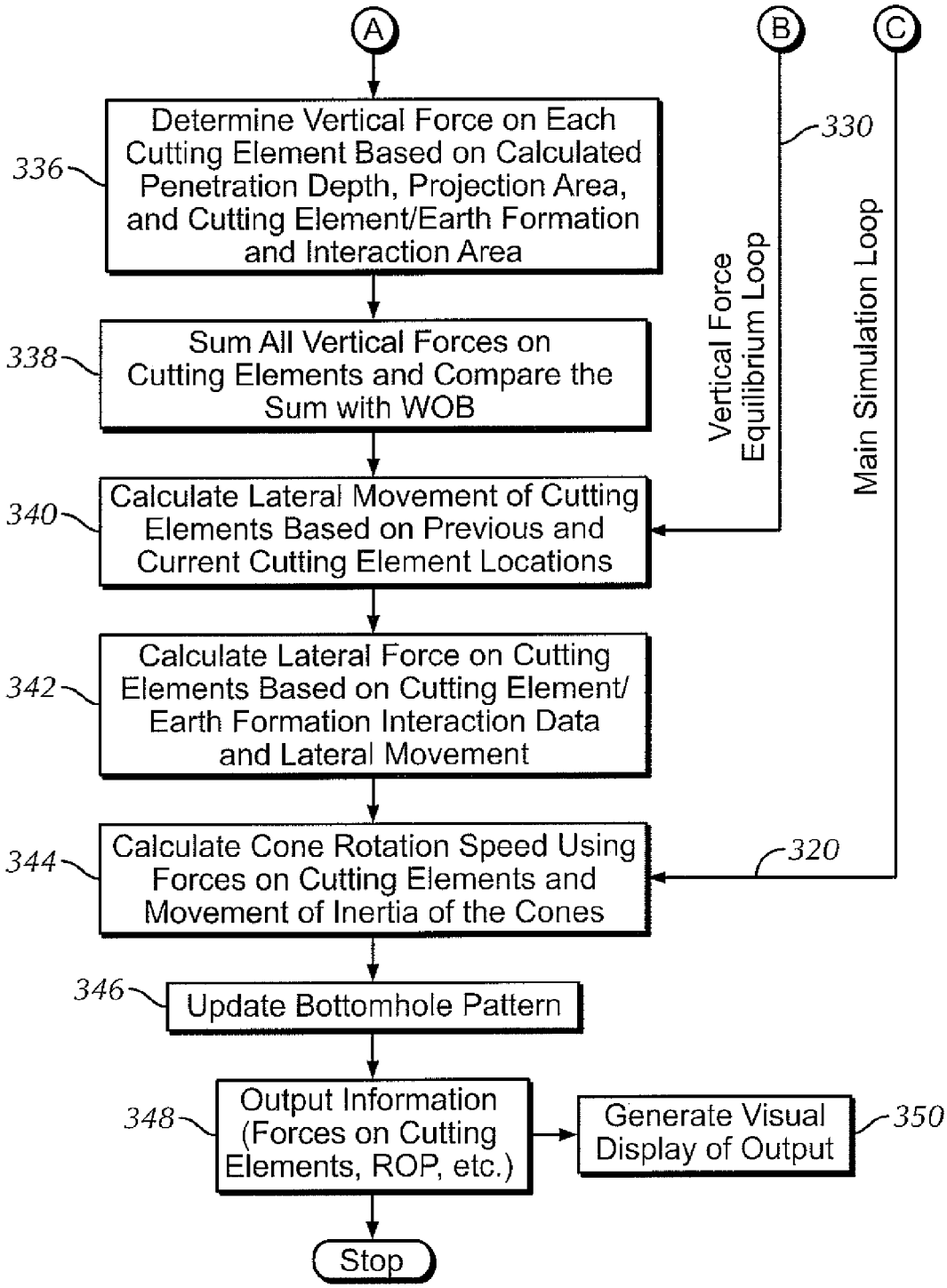
Figure 4:
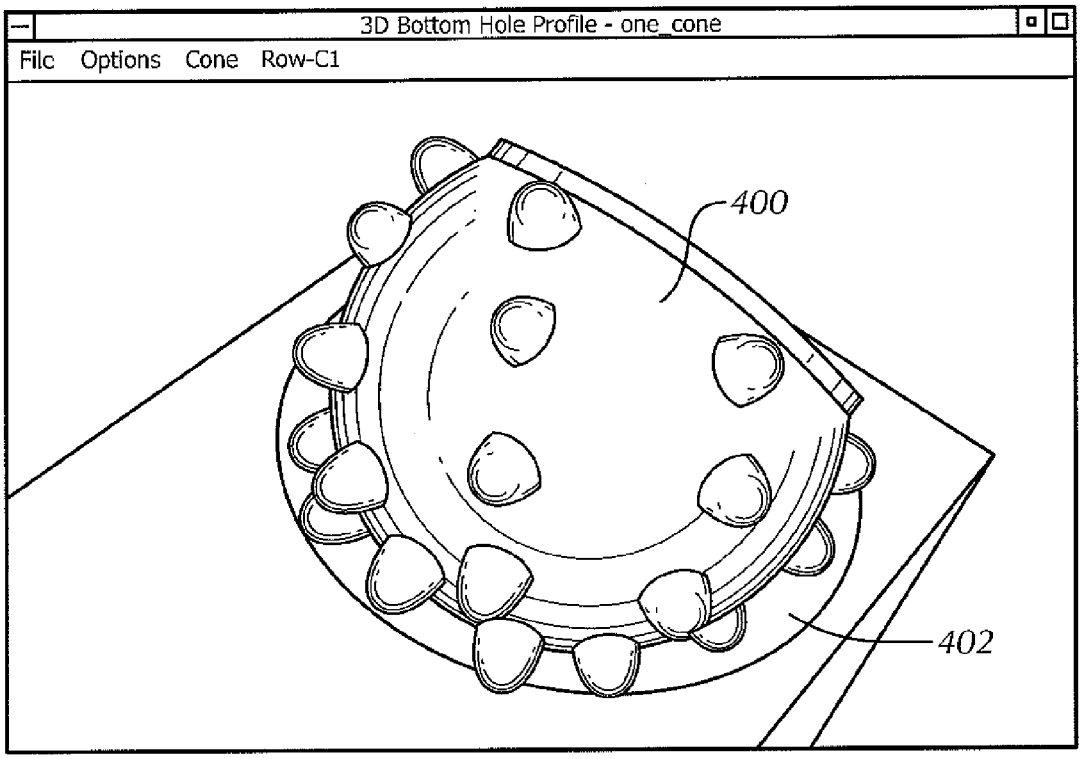
FIG. 4 shows an example of a graphical representation in accordance with an embodiment of the invention.
Figure 5:
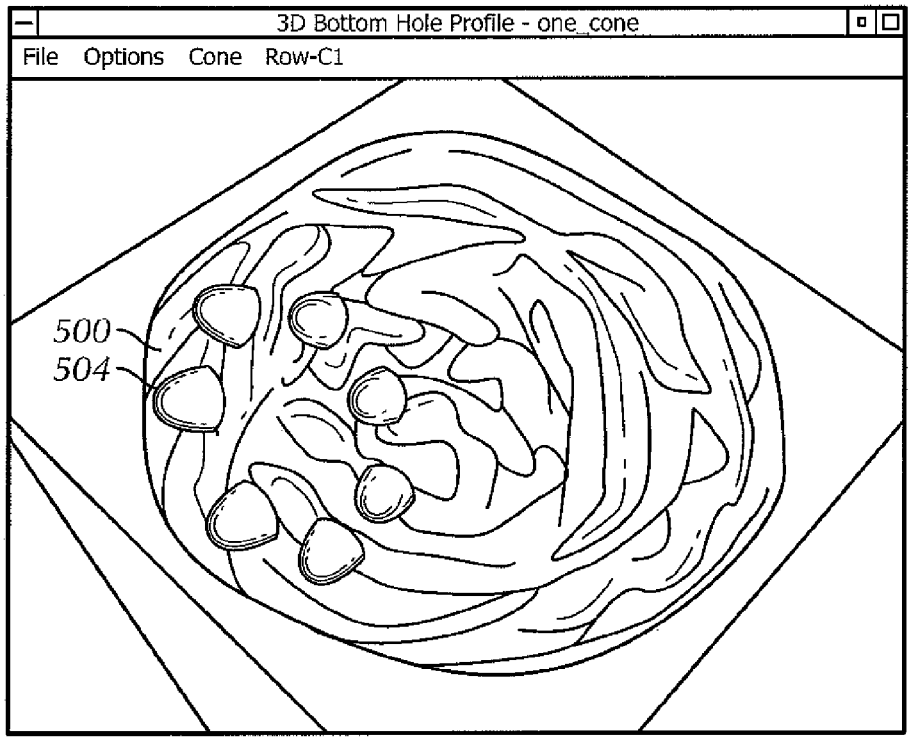
FIG. 5 shows an example of a graphical representation in accordance with an embodiment of the invention.
Figure 6:
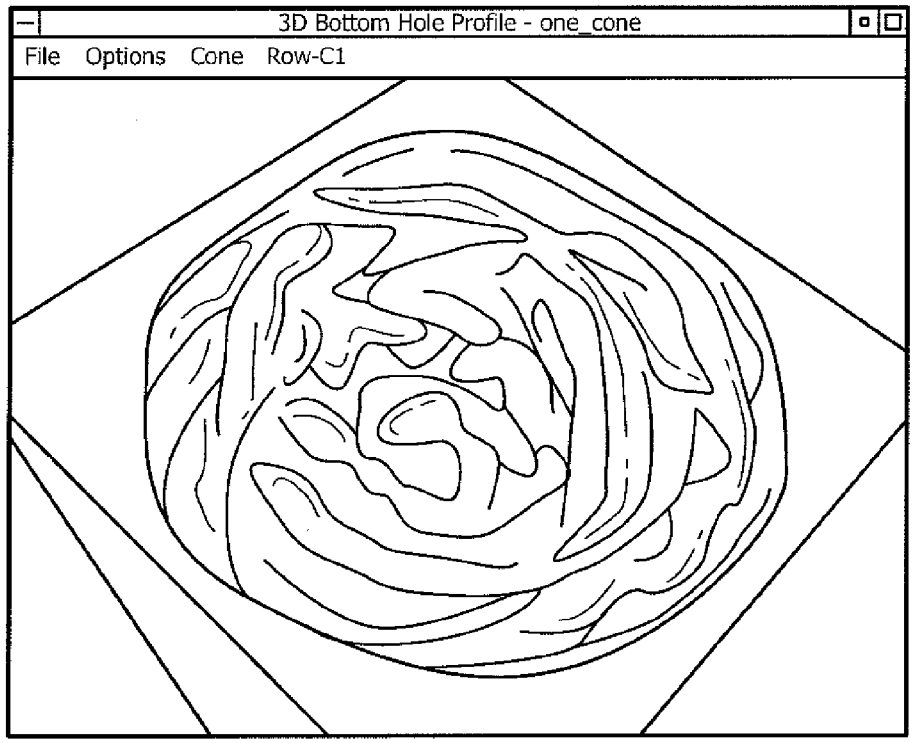
FIG. 6 shows an example of a graphical representation in accordance with an embodiment of the invention.
Figure 7:
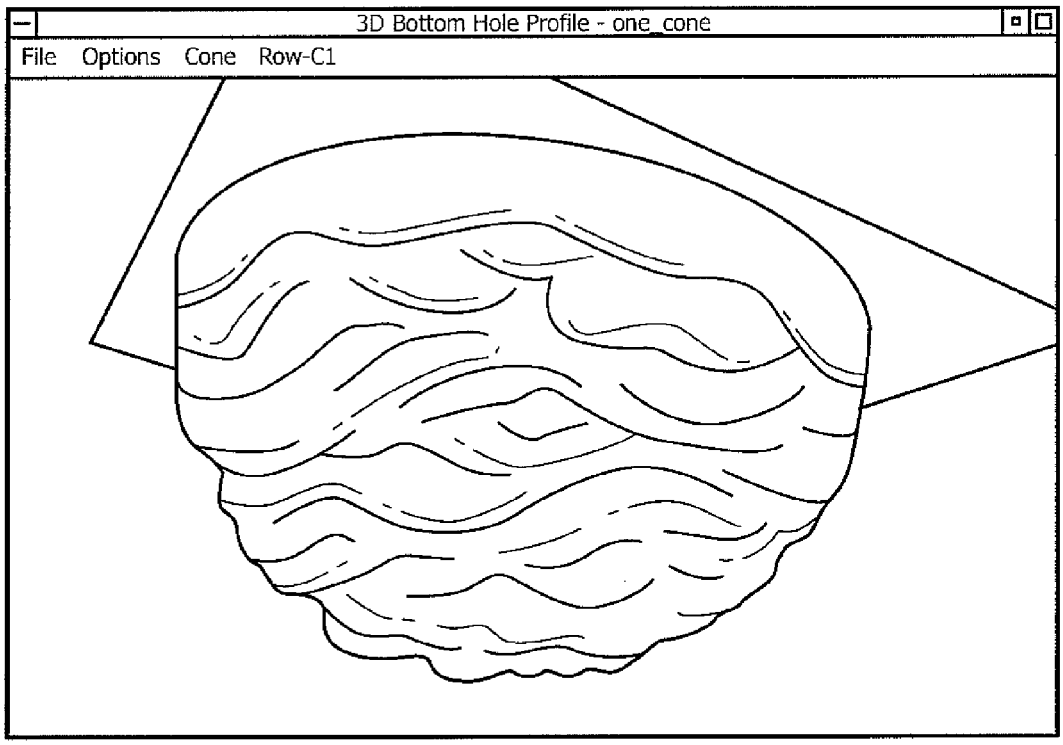
FIG. 7 shows an example of a graphical representation in accordance with an embodiment of the invention.

FIGS. 3A and 3B show a flow chart of one embodiment of the invention for generating a visual representation of a single roller cone drill bit drilling a selected earth formation. The parameters required as input for the simulation include drilling parameters 310, bit design parameters 312, cutting element/earth formation interaction data 314, and bottomhole geometry data 316. In addition, an initial bit speed/cone speed rotation ratio may be entered. Typically the bottomhole geometry prior to any drilling simulation will be a planar surface, but this is not a limitation on the invention. The input data 310, 312, 314, 316 may be stored in an input library and later retrieved as need during simulation calculations.

Drilling parameters 310 which may be used include the axial force applied on the drill bit (commonly referred to as the weight on bit "WOB"), and the rotational speed of the drill bit (typically provided in revolutions per minute "RPM"). It must be understood that drilling parameters are not limited to these variables, but may include other variables, such as, for example, rotary torque and mud flow volume. Additionally, drilling parameters 310 provided as input may include the total number of bit revolutions to be simulated, as shown in FIG. 3A. However, it should be understood that the total number of revolutions is provided simply as an end condition to signal the stopping point of simulation and is not necessary for the calculations required to simulate or visually represent drilling. Alternatively, another end condition may be employed to determine the termination point of simulation, such as the total drilling depth (axial span) to be simulated or any other final simulation condition. Alternatively, the termination of simulation may be accomplished by operator command, or by performing any other specified operation.

Bit design parameters 312 used as input include bit cutting structure information, such as the cutting element location and orientation on the roller cones, and cutting element information, such as cutting element size(s) and shape(s). Bit design parameters 312 may also include bit diameter, cone diameter profile, cutting element count, cutting element height, and cutting element spacing between individual cutting elements. The cutting element and single roller cone geometry can be converted to coordinates and used as input for the invention. Preferred methods for bit design parameter inputs include the use of 3-dimensional CAD solid or surface models to facilitate geometric input.

Cutting element/earth formation interaction data 314 used as input includes data which characterize the interaction between a selected earth formation (which may have, but need not necessarily have, known mechanical properties) and an individual cutting element having known geometry.

Bottomhole geometry data 316 used as input includes geometrical information regarding the bottomhole surface of an earth formation, such as the bottomhole shape. As previously explained, the bottomhole geometry typically will be planar at the beginning of a simulation using the invention, but this is not a limitation on the invention. The bottomhole geometry can be represented as a set of axial (depth) coordinates positioned within a defined coordinate system, such as in a cartesian coordinate system. In this embodiment, a visual representation of the bottomhole surface is generated using a coordinate mesh size of 1 millimeter, but the mesh size is not a limitation on the invention.

As shown in FIG. 3A, once the input data 310-316 are entered or otherwise made available, calculations in the main simulation loop 320 can be carried out. To summarize the functions performed in the main simulation loop 320, drilling simulation is incrementally calculated by "rotating" the bit through an incremental angle, and then iteratively determining the vertical (axial) displacement of the bit corresponding to the incremental bit rotation. Once the vertical displacement is obtained, the lateral forces on the cutting elements are calculated and are used to determine the current rotation speed of the cone. Finally, the bottomhole geometry is updated by removing the deformed earth formation resulting from the incremental drilling calculated in the simulation loop 320. A more detailed description of the elements in the simulation loop 320 is as follows.

The first element in the simulation loop 320 in FIG. 3A, involves "rotating" the single cone roller cone bit (numerically) by the selected incremental angle amount, $\Delta\theta_{bit,i}$, 322. In this example embodiment, the selected incremental angle is 3 degrees. It should be understood that the incremental angle is a matter of convenience for the system designer and is not intended to limit the invention. The incremental rotation of the bit results in an incremental rotation of the cone on the bit, $\Delta\theta_{cone,i}$. To determine the incremental rotation of the cone, $\Delta\theta_{cone,i}$, resulting from the incremental rotation of the bit, $\Delta\theta_{bit,i}$, requires knowledge of the rotational speed of the cone. In one example, the rotational speed of the cone is determined by the rotational speed of the bit and the effective radius of the "drive row" of the cone. The effective radius is generally related to the radial extent of the cutting elements that extend axially the farthest from the axis of rotation of the cone, these cutting elements generally being located on a so-called "drive row". Thus the rotational speed of the cone can be defined or calculated based on the known bit rotational speed of the bit and the defined geometry of the cone provided as input (e.g., the cone diameter profile, and cone axial offset). Then the incremental rotation of the cone, $\Delta\theta_{cone,i}$, is calculated based on incremental rotation of the bit, $\Delta\theta_{bit,i}$, and the calculated rotational speed of the cone 324.

Once the incremental angle of each cone $\Delta\theta_{cone,i}$ is calculated, the new locations of the cutting elements, $p_{\Theta,i}$ are computed based on bit rotation, cone rotation, and the immediately previous locations of the cutting elements $p_{i-1}$. The new locations of the cutting elements 326 can be determined by geometric calculations known in the art. Based on the new locations of the cutting elements, the vertical displacement of the bit resulting from the incremental rotation of the bit is, in this embodiment, iteratively computed in a vertical force equilibrium loop 330.

In the vertical force equilibrium loop 330, the bit is "moved" (axially) downward (numerically) a selected initial incremental distance $\Delta d_i$ and new cutting element locations $p_i$ are calculated, as shown at 332 in FIG. 3A. In this example, the selected initial incremental distance is 2 mm. It should be understood that the initial incremental distance selected is a matter of convenience for the system designer and is not intended to limit the invention. Then the cutting element interference with the existing bottomhole geometry is determined, at 334. This includes determining the depth of penetration of each cutting element into the earth formation, and a corresponding interference projection area. The depth of penetration is defined as the distance from the formation surface a cutting element penetrates into an earth formation, which can range from zero (no penetration) to the full height of the cutting element (full penetration). The interference projection area is the fractional amount of surface area of the cutting element which actually contacts the earth formation. Upon first contact of a cutting element with the earth formation, such as when the formation presents a smooth, planar surface to the cutting element, the interference projection area is substantially equal to the total contact surface area corresponding to the depth of penetration of the cutting element into the formation.

However, upon subsequent contact of cutting elements with the earth formation during simulated drilling, each cutting element may have subsequent contact over less than the total contact area. This less than full area contact comes about as a result of the formation surface having "craters" (deformation pockets) made by previous contact with a cutting element. Fractional area contact on any of the cutting elements reduces the axial force on those cutting elements, which can be accounted for in the simulation calculations.

Once the cutting element/earth formation interaction is determined for each cutting element, the vertical force, $f_{V,i}$ applied to each cutting element is calculated based on the calculated penetration depth, the projection area, and the cutting element/earth formation interaction data 312. This is shown at 336 in FIG. 3B. Thus, the axial force acting on each cutting element is related to the cutting element penetration depth and the cutting element interference projection area. In this embodiment, a simplifying assumption used in the simulation is that the WOB is equal to the summation of vertical forces acting on each cutting element. Therefore the vertical forces, $f_{V,i}$, on the cutting elements are summed to obtain a total vertical force $F_{V,i}$ on the bit, which is then compared to the selected axial force applied to the bit (the WOB) for the simulation, as shown at 338. If the total vertical force $F_{V,i}$ is greater than the WOB, the initial incremental distance $\Delta d_i$ applied to the bit is larger than the incremental axial distance that would result from the selected WOB. If this is the case, the bit is moved up a fractional incremental distance (or, expressed alternatively, the incremental axial movement of the bit is reduced), and the calculations in the vertical force equilibrium loop 330 are repeated for the resulting incremental distance.

If the total vertical force $F_{V,i}$ on the cutting elements, using the resulting incremental axial distance is then less than the WOB, the resulting incremental distance $\Delta d_i$ applied to the bit is smaller than the incremental axial distance that would result from the selected WOB. In this case, the bit is moved further down a second fractional incremental distance, and the calculations in the vertical force equilibrium loop 330 are repeated for the second resulting incremental distance. The vertical force equilibrium loop 330 calculations iteratively continue until an incremental axial displacement for the bit is obtained which results in a total vertical force on the cutting elements substantially equal to the selected WOB, within a selected error range.

Once the incremental displacement, $\Delta d_i$, of the bit is obtained, the lateral movement of the cutting elements is calculated based on the previous, $p_{i-1}$, and current, $p_i$, cutting element locations, as shown at 340. Then the lateral force, $f_{L,i}$, acting on the cutting elements is calculated based on the lateral movement of the cutting elements and cutting element/earth formation interaction data, as shown at 342. Then the cone rotation speed is calculated based on the forces on the cutting elements and the moment of inertia of the cone, as shown at 344.

Finally, the bottomhole pattern is updated, at 346, by calculating the interference between the previous bottomhole pattern and the cutting elements during the current incremental drilling step, and based on cutting element/earth formation interaction, "removing" the formation resulting from the incremental rotation of the selected bit with the selected WOB. In this example, the interference can be represented by a coordinate mesh or grid having 1 mm grid blocks.

This incremental simulation loop 320 can then be repeated by applying a subsequent incremental rotation to the bit 322 and repeating the calculations in the incremental simulation loop 320 to obtain an updated bottomhole geometry. Using the total bit revolutions to be simulated as the termination command, for example, the incremental displacement of the bit and subsequent calculations of the simulation loop 320 will be repeated until the selected total number of bit revolutions to be simulated is reached. Repeating the simulation loop 320 as described above will result in simulating the performance of a single roller cone drill bit drilling earth formations with continuous updates of the bottomhole pattern drilled, simulating the actual drilling of the bit in a selected earth formation. Upon completion of a selected number of operations of the simulation loops 320, results of the simulation can be programmed to provide output information at 348 characterizing the performance of the selected drill bit during the simulated drilling, as shown in FIG. 3B. It should be understood that the simulation can be stopped using any other suitable termination indicator, such as a selected axial displacement.

Referring back to the embodiment of the invention shown in FIGS. 3A and 3B, drilling parameters 310, bit design parameters 312, and bottomhole parameters 316 required as input for the simulation loop of the invention are distinctly defined parameters that can be selected in a relatively straight forward manner. On the other hand, cutting element/earth formation interaction data 314 is not defined by a clear set of parameters, and, thus, can be obtained in a number of different ways.

In one embodiment of the invention, cutting element/earth formation interaction data 314 may comprise a library of data obtained from actual tests performed using selected cutting elements, each having known geometry, on selected earth formations. In this embodiment, the tests include using a single cone bit having a known geometry on the selected earth formation with a selected force. The selected earth formation may have known mechanical properties, but it is not essential that the mechanical properties be known. Then the resulting grooves formed in the formation as a result of the interaction between the inserts and the formation are analyzed. These tests can be performed for different cutting elements, different earth formations, and different applied forces, and the results analyzed and stored in a library for use by the simulation method of the invention. These tests can provide good representation of the interaction between cutting elements and earth formations under selected conditions.

In one embodiment, these tests may be repeated for the single cone in the same earth formation under different applied loads, until a sufficient number of tests are performed to characterize the relationship between interference depth and impact force applied to the cutting element. Tests are then performed for other selected cutting elements and/or earth formations to create a library of crater shapes and sizes and information regarding interference depth/impact force for different types of single cone bits in selected earth formations.

Alternatively, single insert tests, such as those described in U.S. Pat. No. 6,516,293, which is incorporated herein by reference in its entirety, may be used in simulations to predict the expected deformation/fracture crater produced in a selected earth formation by a selected cutting element under specified drilling conditions.

In another embodiment of the invention, techniques such as Finite Element Analysis, Finite Difference Analysis, and Boundary Element Analysis may be used to determine the motion of the cone. For example, the mechanical properties of an earth formation may be measured, estimated, interpolated, or otherwise determined, and the response of the earth formation to cutting element interaction may be calculated using Finite Element Analysis. In other embodiments, the trajectory of the inserts on a single cone bit may be predicted by using mathematical relationships such as those set forth above.

Thus, the above methodology provides a method for simulating a single cone roller cone bit. Some embodiments of the invention include graphically displaying the simulation of the single cone roller cone bit and other embodiments include a method has proper (e.g., full) bottomhole coverage or to ensure that the various cutting elements are not tracking.

After the simulation phase is complete, the data collected by the simulation may be displayed to a designer in a number of various formats. FIGS. 8-24 illustrate such exemplary graphical displays. In designing a single cone roller cone bit, one criterion that may interest a designer is the number of cutting elements in contact with the formation at any given time. In an ideal case the cutting elements are disposed on the bit such that the same number of cutting elements contacts the formation at each point in time throughout drilling. However, in actual single cone bits, the number of cutting elements which contacts the formation differs at each point in time throughout drilling. For example, at one instant in time the cone may have twelve cutting elements in contact with a formation. At another instant in time the cone may have twenty cutting elements in contact with the formation. At a third instant in time the cone may have sixteen cutting elements in contact with the formation.

Figure 8:
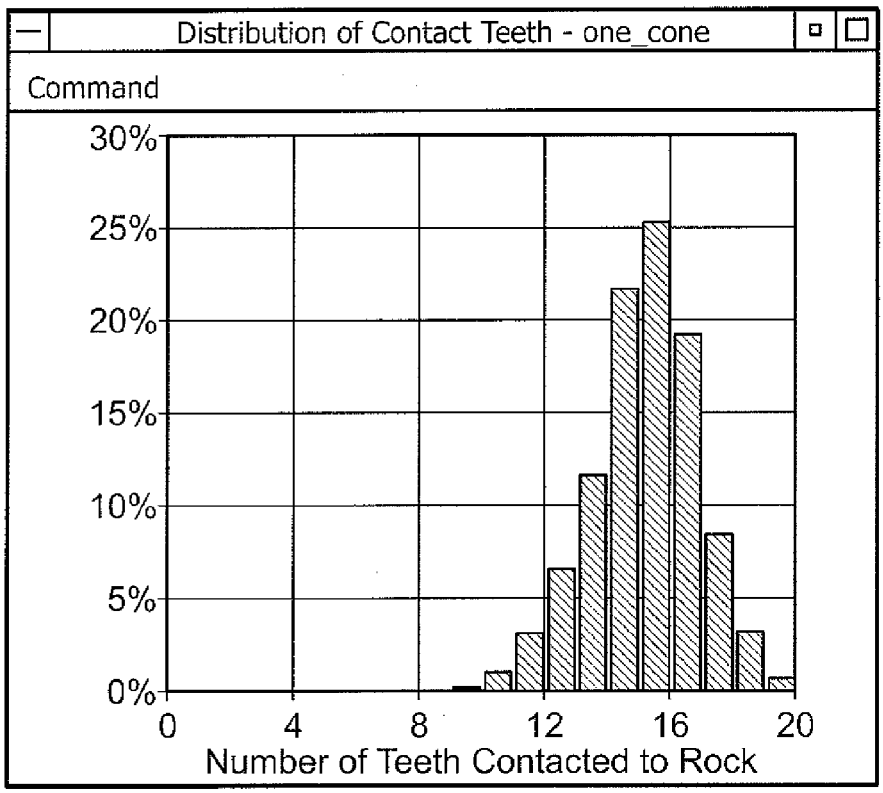
FIG. 8 shows an example of a graphical representation in accordance with an embodiment of the invention.

Therefore, in order to determine whether the number of cutting elements on the single cone bit contacting a formation is substantially the same during drilling, the fraction of the total time that each number of cutting elements instantaneously contacts the formation must be compared. FIG. 8 shows one example graphical display. In FIG. 8, for example, the single cone bit has fourteen cutting elements in contact with the formation for approximately 25% of the time. By contrast, the single cone bit has twelve cutting elements in contact with the formation approximately 7% of the time. In one embodiment of the invention, the distribution of cutting elements is compared between a first single cone bit design and a second single cone bit design. In another embodiment of the invention, the WOB or other drilling parameters is changed and the distribution of cutting elements in contact with the formation is compared between the first set of drilling parameters and a second set of drilling parameters.

Thus, in one aspect, the present invention includes a single cone bit having a plurality of cutting elements arranged on the cone so that the number of cutting elements contacting the earth formation during drilling is substantially the same at different times. The number of cutting elements on a cone in contact with an earth formation at a given point in time is a function of, among other factors, the total number of cutting elements on the cone, the profile of the bottomhole surface, and the arrangement of the cutting elements on the cone. In one embodiment of this aspect of the invention, the cutting elements are disposed such that a fraction of time each of a number of cutting elements contacts the formation less than about a 20% difference during a substantial portion of the drilling time.

Figure 9:
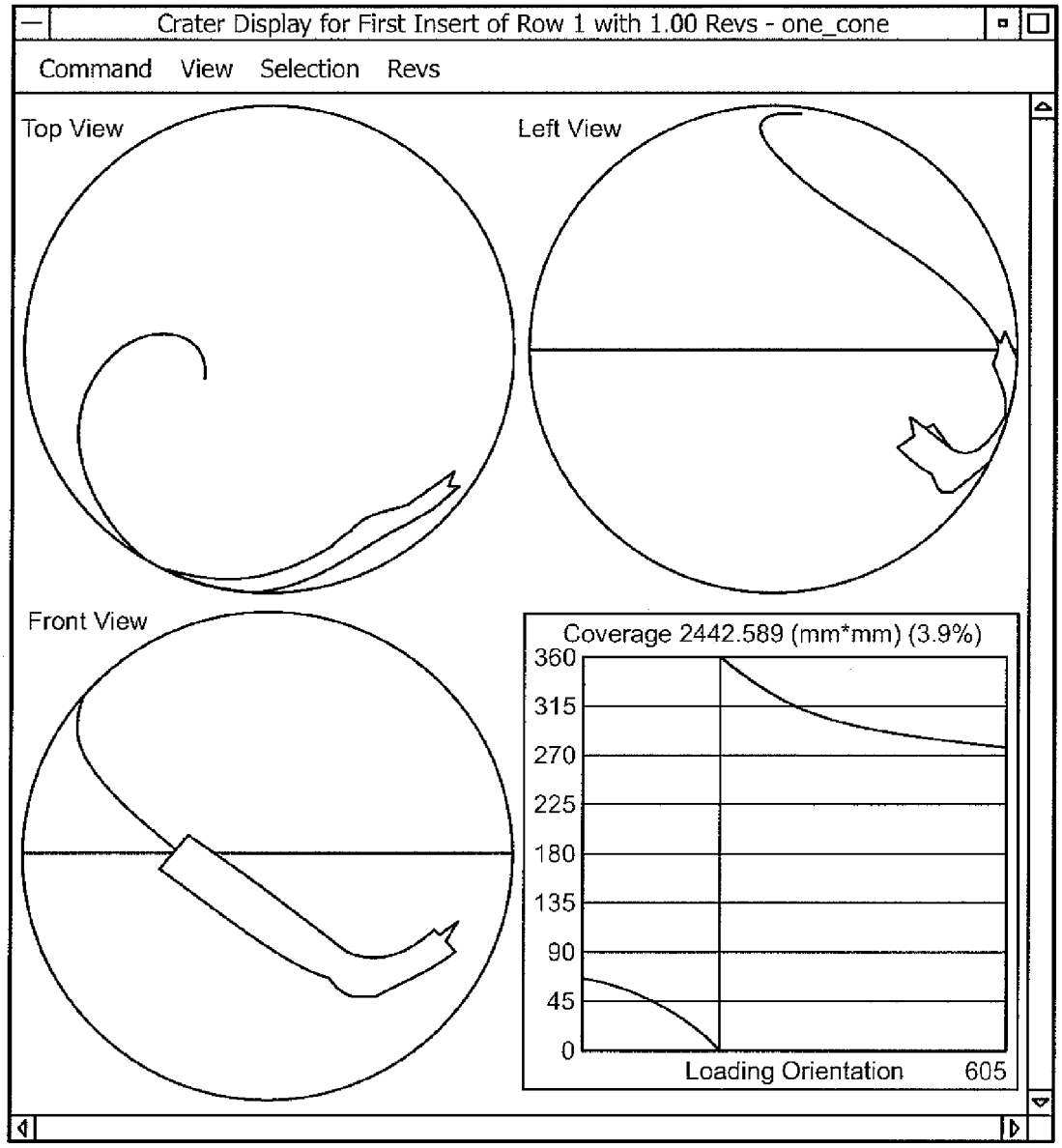
FIG. 9 shows an example of a graphical representation in accordance with an embodiment of the invention.

Turning to FIG. 9, the trajectory and coverage/loading orientation for an insert on row 1 of a single cone bit is shown. In FIG. 9, the "top view," "left view," and "front view," are different views of the trajectory that a single insert has during one revolution of the bit. With respect to the display entitled "loading orientation," this window illustrates what part of the cutting element is actually cutting during the revolution of the bit. As explained above, because of the trajectory that the inserts take through the formation, various "faces" of the cutting element contact the formation at different times, leading to global wear, as opposed to multiple cone bits in which the wear is generally localized at the leading face of the insert. As can be seen from the loading orientation display (indicated by the large vertical jump), during the revolution of the bit, the insert "flips," so that the face of the cutting element opposite the face originally doing the cutting now cuts the formation.

Figure 10:
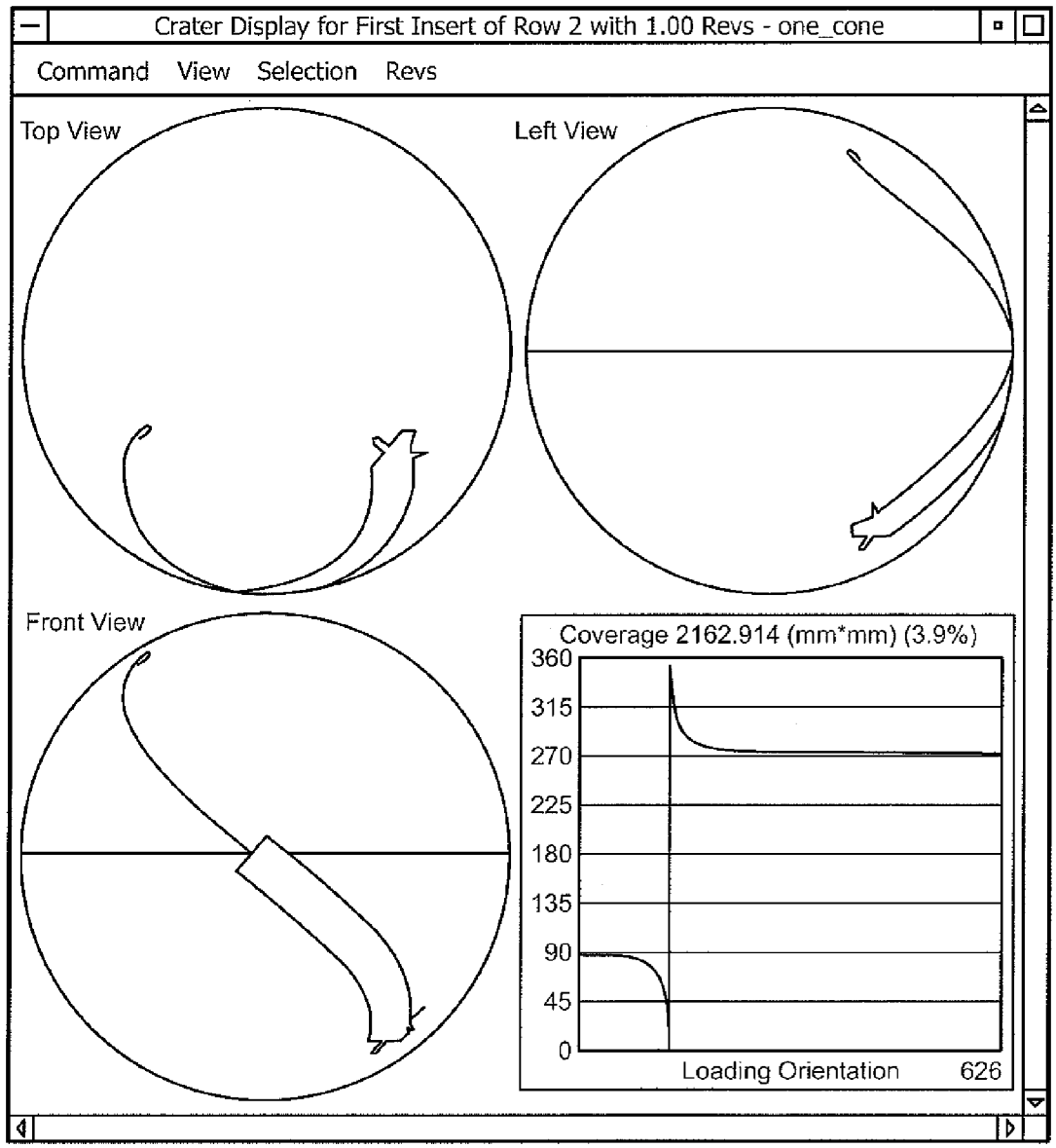
FIG. 10 shows an example of a graphical representation in accordance with an embodiment of the invention.
Figure 11:
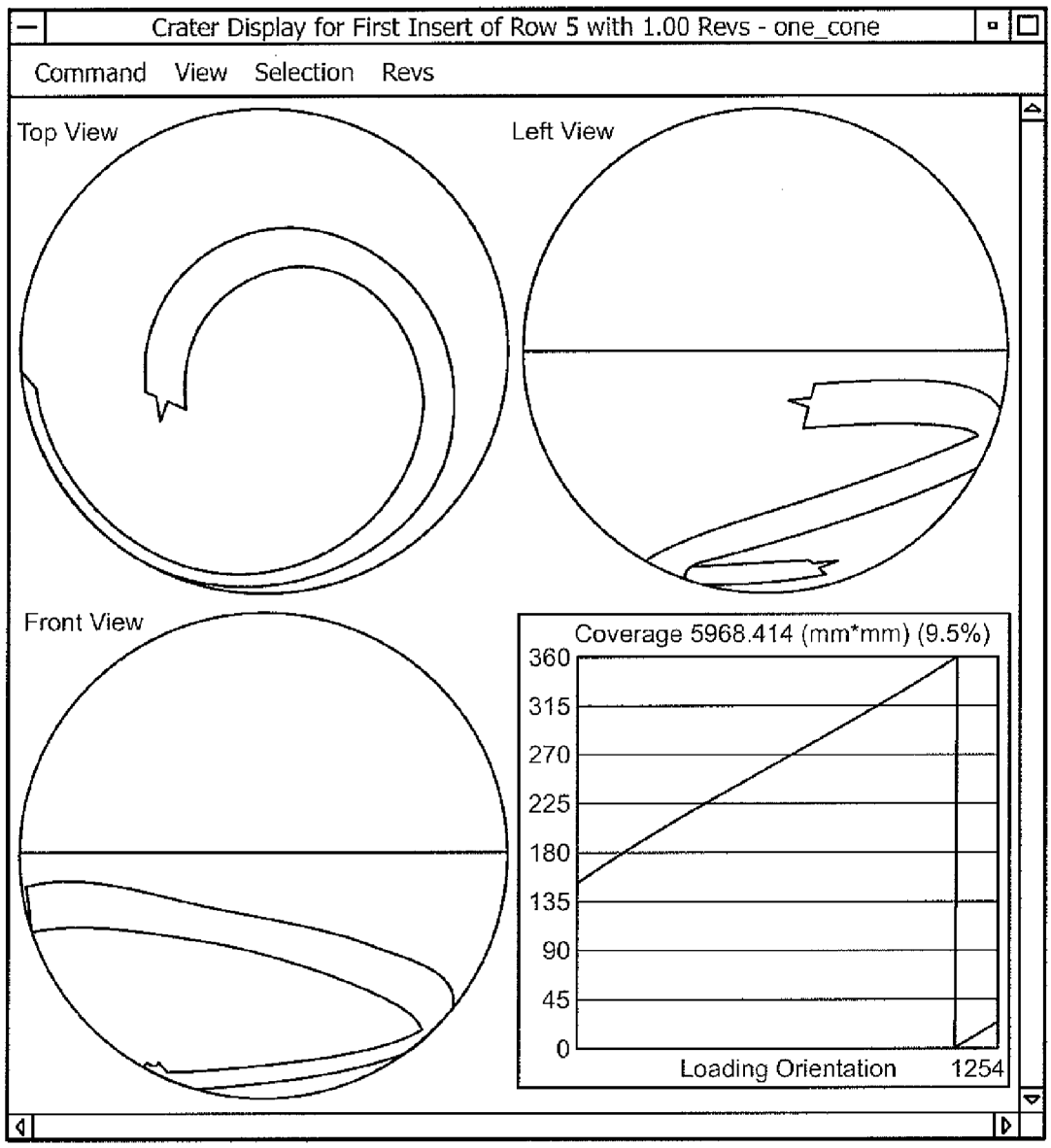
FIG. 11 shows an example of a graphical representation in accordance with an embodiment of the invention.

FIG. 10 is similar to FIG. 9, except that the display is for a cutting element on row 2. Comparing FIG. 9 with FIG. 10, it is apparent that the cutting element on row 1 and row 2 have different trajectories and bottomhole coverage as the bit rotates. Similarly, FIG. 11 shows the trajectory and bottomhole coverage that a cutting element on row 5 takes. In FIGS. 9-11, when the cutting element is in contact with the formation (i.e., drilling), a broad, thick line is displayed. The trajectory for the cutting element when not in contact with the formation is shown as a single line.

Figure 12:
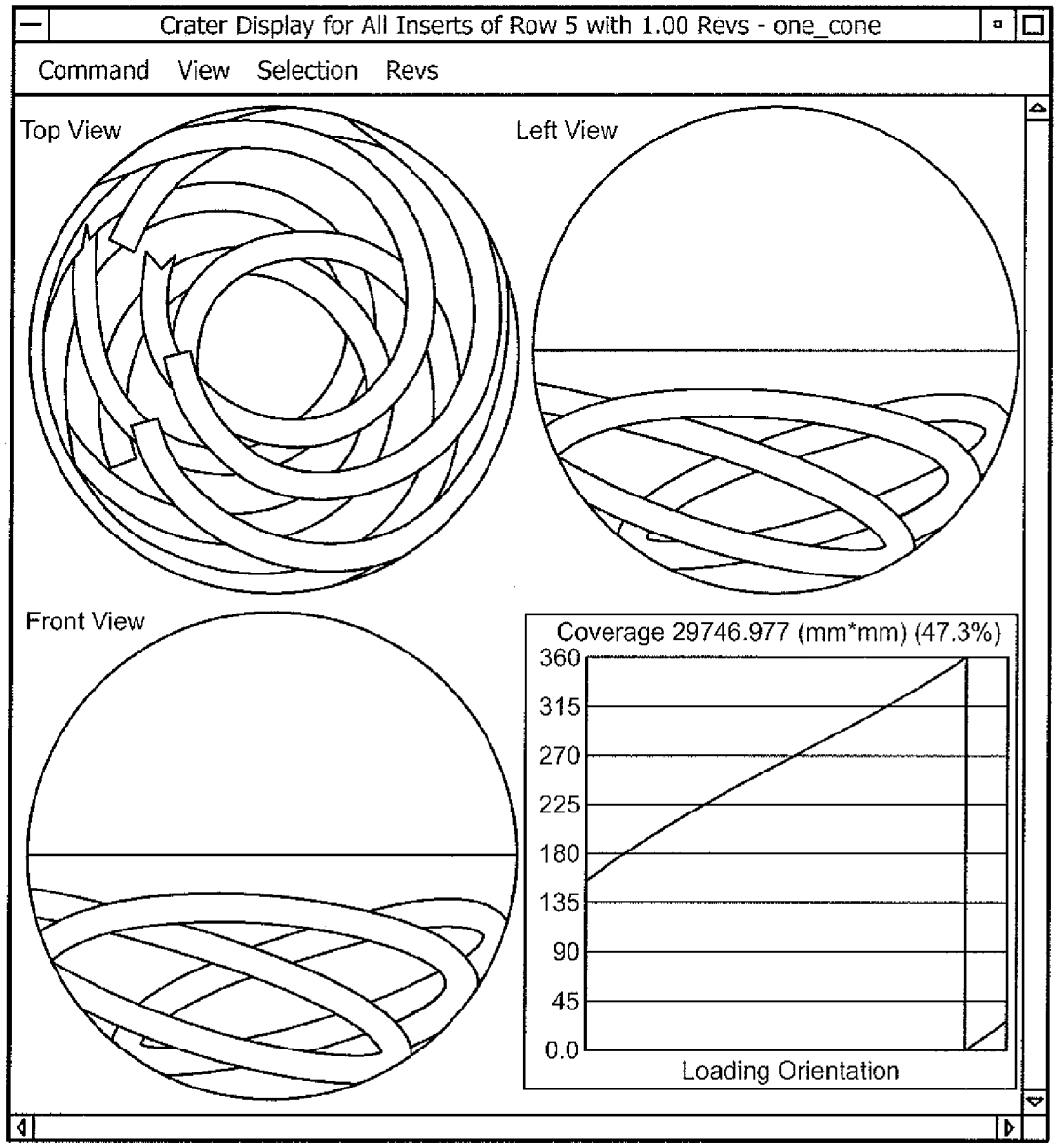
FIG. 12 shows an example of a graphical representation in accordance with an embodiment of the invention.

FIG. 12 shows a display for all of the inserts on row 5. In this Figure, the hypotrochoid bottomhole pattern is apparent.

Figure 13:
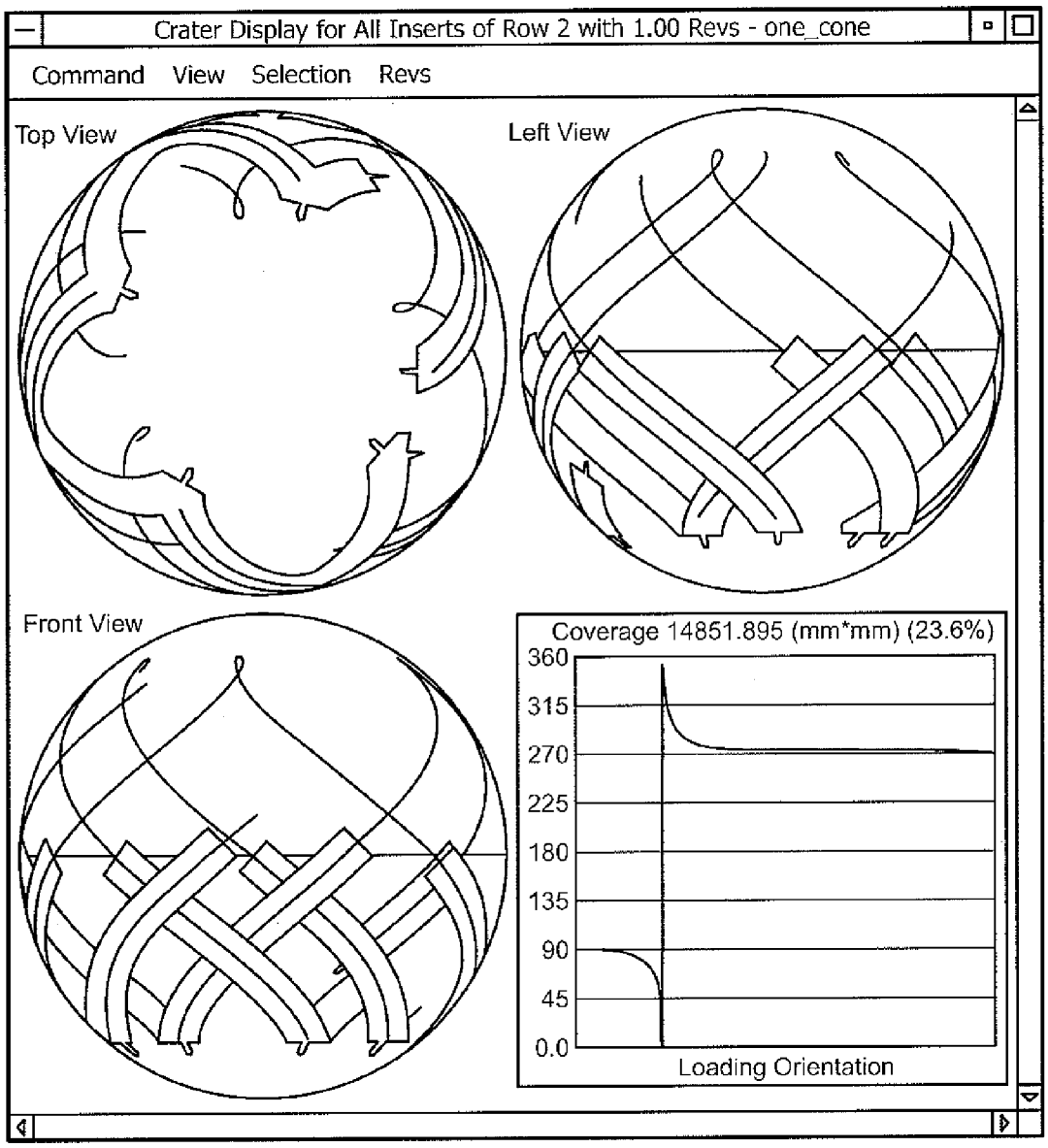
FIG. 13 shows an example of a graphical representation in accordance with an embodiment of the invention.
Figure 14:
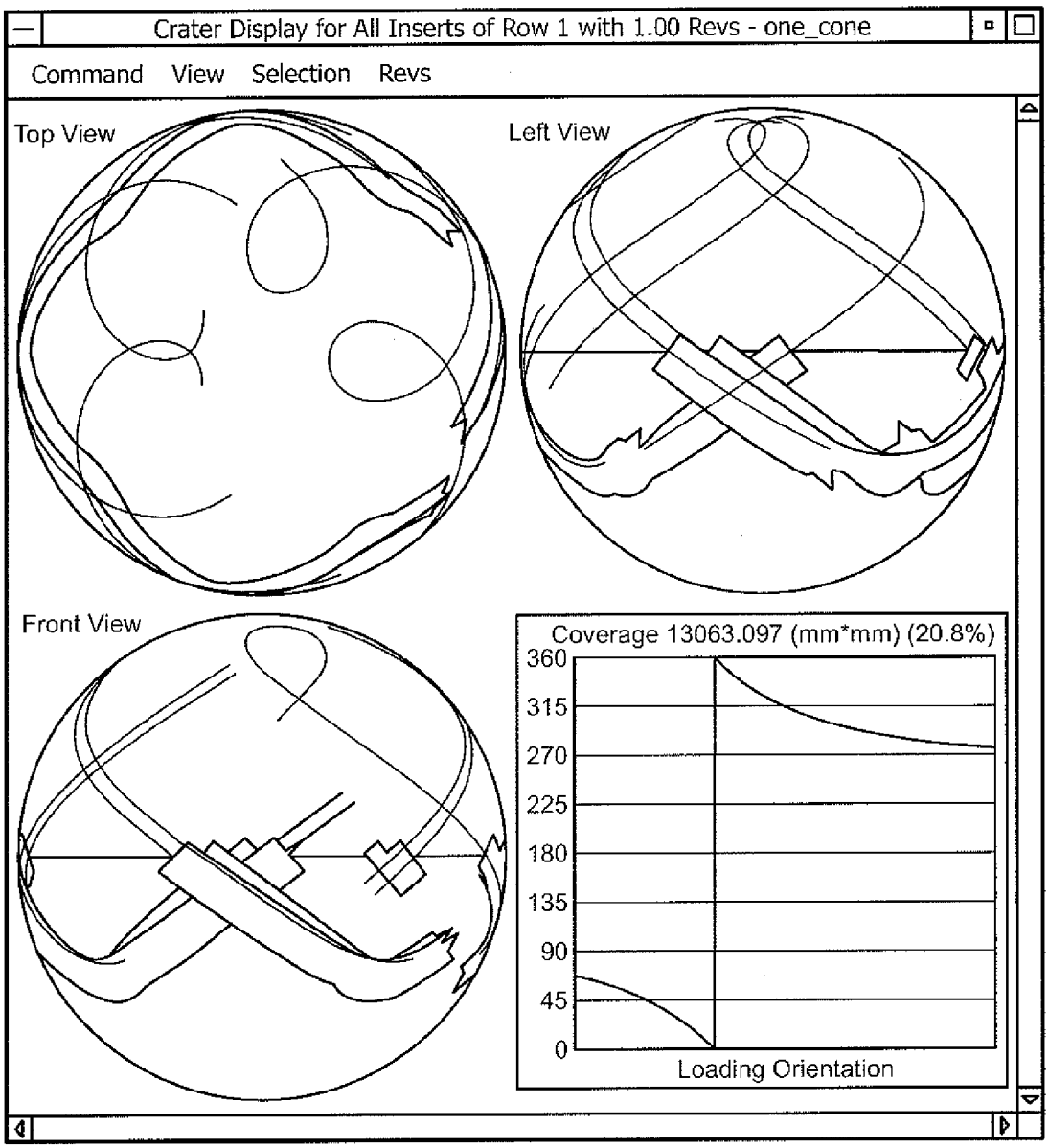
FIG. 14 shows an example of a graphical representation in accordance with an embodiment of the invention.

Similarly, FIGS. 13 and 14 show the trajectory and coverage for rows 2 and 1, respectively. By looking at one or combinations of these figures, a designer can compare cutting element trajectory and coverage of different cutting elements, rows of cutting elements, or amongst different designs of bits.

Figure 15:
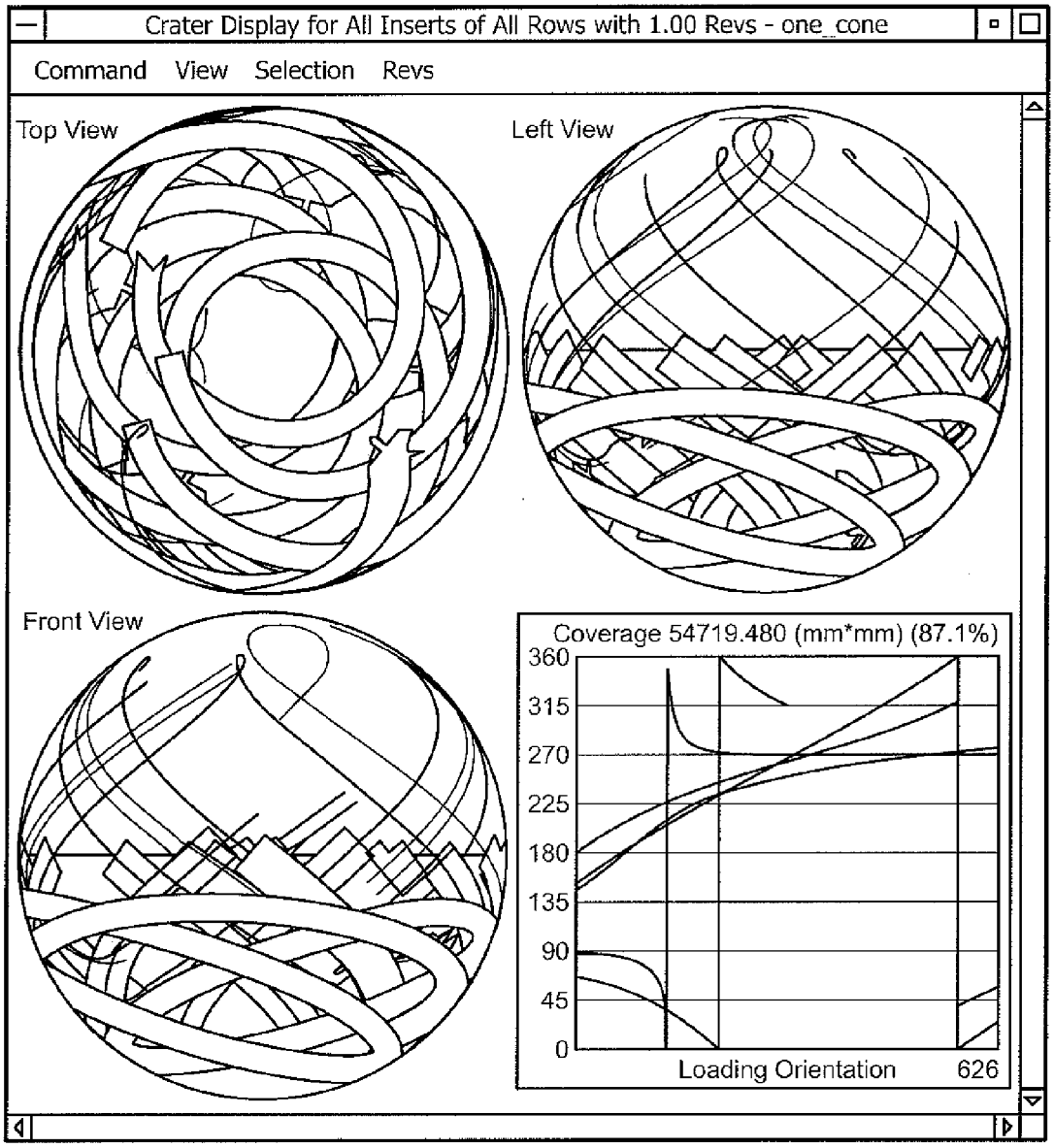
FIG. 15 shows an example of a graphical representation in accordance with an embodiment of the invention.

FIG. 15 shows a display for all inserts on all rows of the single cone bit. By looking at this Figure, a designer can compare the bottomhole coverage between different designs and/or compare the trajectories taken by different cutting elements. Further, the designer may look at the loading orientation on individual cutting elements and/or rows of cutting elements. After looking at any of FIGS. 9-15, a designer may choose to alter the geometric layout of the bit, for example, in order to provide better (i.e., more complete) bottomhole coverage. In addition, cutting elements may be selected to optimize (i.e., improve) wear patterns, by looking at the loading orientation. Determination of the relative wear of cutting elements is explained in more detail below. Those having ordinary skill in the art will recognize that displaying the trajectory of the cutting elements, whether individually or in rows, can provide a significant amount of useful information to a bit designer.

Figure 16:
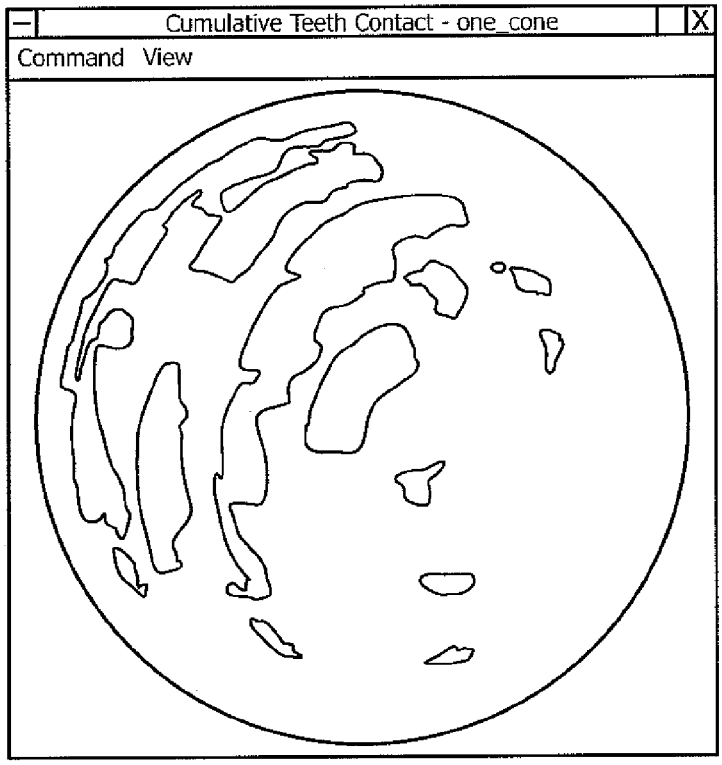
FIG. 16 shows an example of a graphical representation in accordance with an embodiment of the invention.
Figure 17:
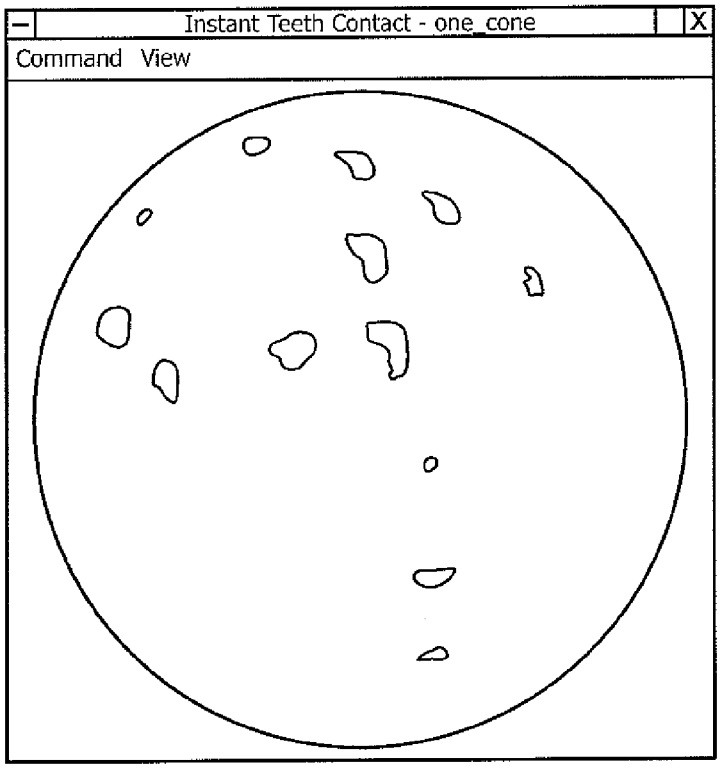
FIG. 17 shows an example of a graphical representation in accordance with an embodiment of the invention.

FIG. 16 shows another graphical display in accordance with an embodiment of the invention. In FIG. 16, the cumulative cutting element contact is shown. That is, FIG. 16 shows a view of the total contact that the cutting elements have had with the formation. By contrast, FIG. 17 shows the instantaneous "real-time" simulation of which cutting elements are in contact with the formation at any given instant in time. Both of these displays can be viewed by a designer during the simulation phase.

Figure 18:
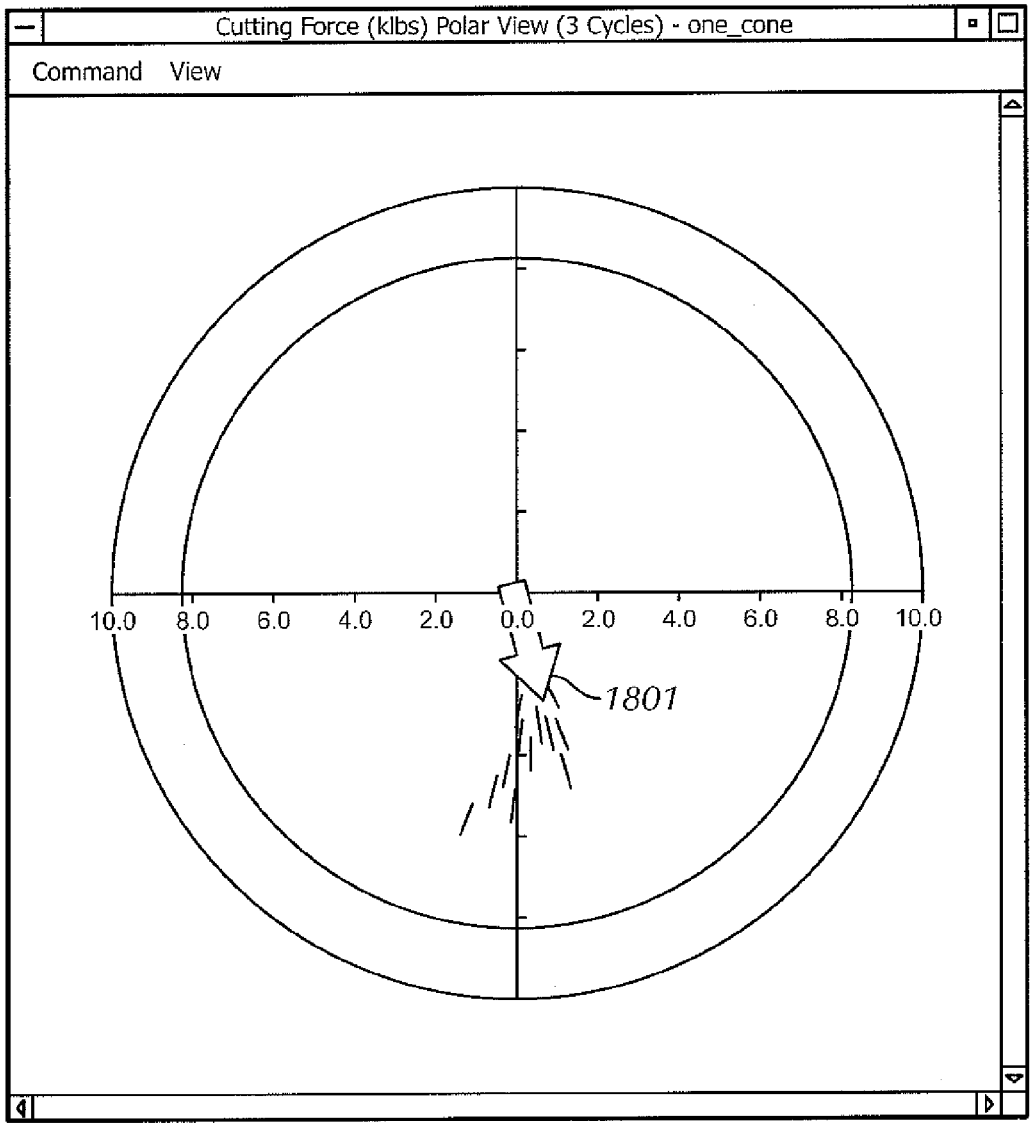
FIG. 18 shows an example of a graphical representation in accordance with an embodiment of the invention.

FIG. 18 shows another graphical display in accordance with an embodiment of the invention. In FIG. 18, the polar (radial) forces acting on the bit are displayed. The forces are displayed with both a magnitude (indicated by the size of the arrow 1801) and a direction (indicated by the position of the arrow 1801).

Figure 19A:
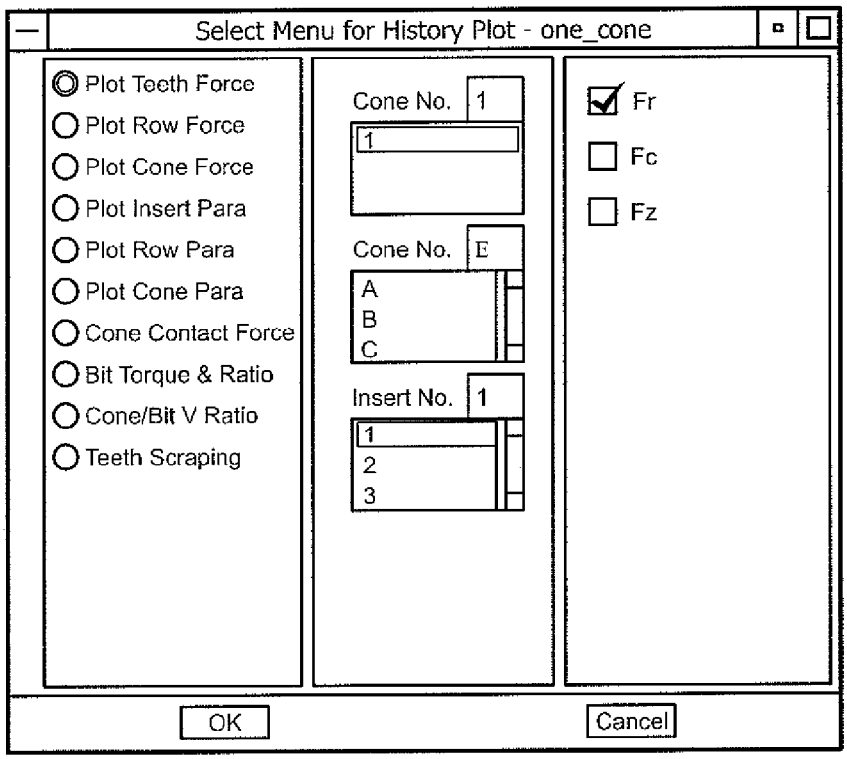
FIG. 19A shows an example of a menu in accordance with an embodiment of the invention.
Figure 19B:
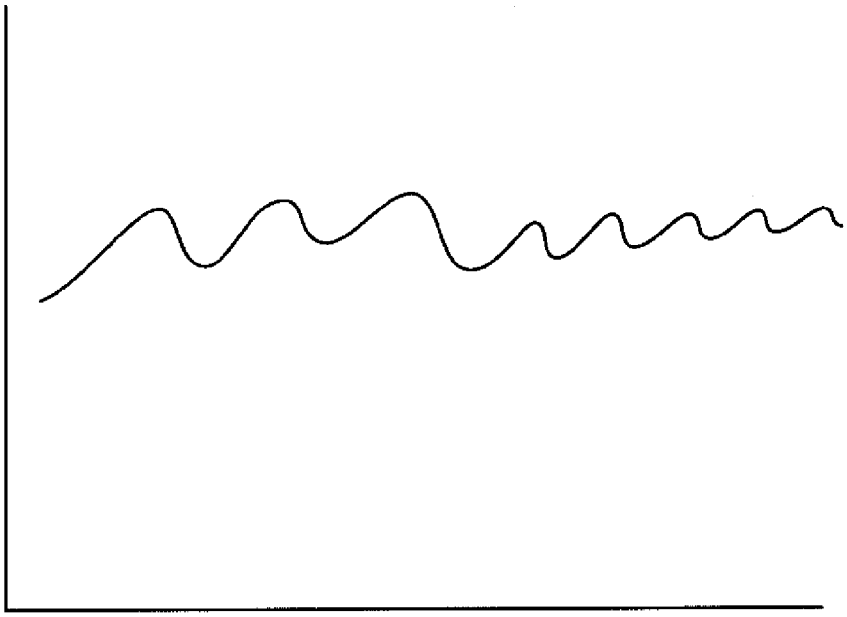
FIG. 19B shows an example of a graphical representation in accordance with an embodiment of the invention.
Figure 20:
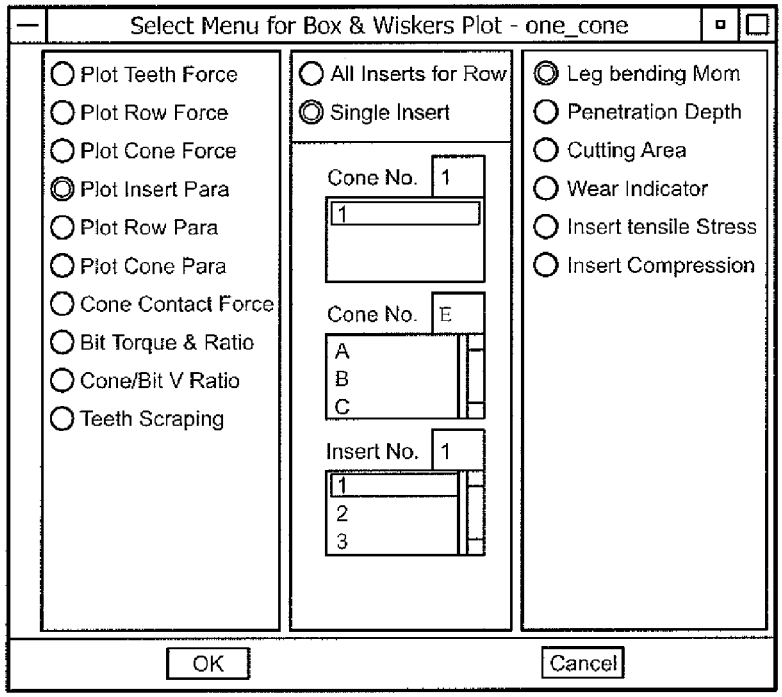
FIG. 20 shows an example of a menu in accordance with an embodiment of the invention.

FIG. 19A shows a menu of choices that a designer may choose to display during the simulation phase in one embodiment of the invention. By selecting the options, the designer can display a "real time" plot (which may be displayed, for example, as a moving line, as shown in FIG. 19B) of one or more data being collected. In this exemplary embodiment, the designer can choose to plot the force acting on the cutting elements in either the radial, circumferential, or vertical direction (where this information may be calculated as explained with references to FIGS. 3A and 3B). Further, the designer may select from any of the cutting elements on the bit, by selecting a row and insert number. FIG. 19A shows the drop down menus available in this embodiment.

Similarly, the designer may choose to plot the forces (again in the radial, circumferential, or vertical directions) acting on any one or all of the rows, or on the entire cone. Further, with reference to FIG. 20, the designer may choose to plot insert, row, or cone "parameters," which in this embodiment of the invention include the bending moment, depth of penetration, cutting area, wear indicator, tensile stress, and/or compressive stress. While these will be explained in more detail below, it is important to note that the data collected (which may be displayed graphically) during the simulation phase as described with reference to FIG. 19A, may also be viewed in a number of different forms by a designer during the analysis phase.

Figure 21:
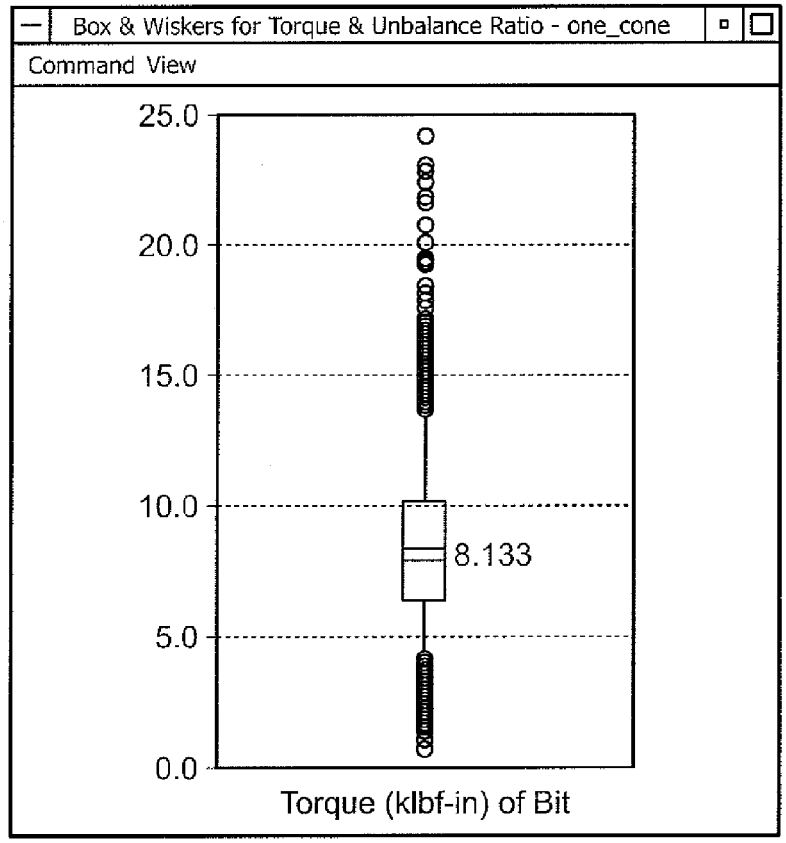
FIG. 21 shows an example of a graphical representation in accordance with an embodiment of the invention.
Figure 22:
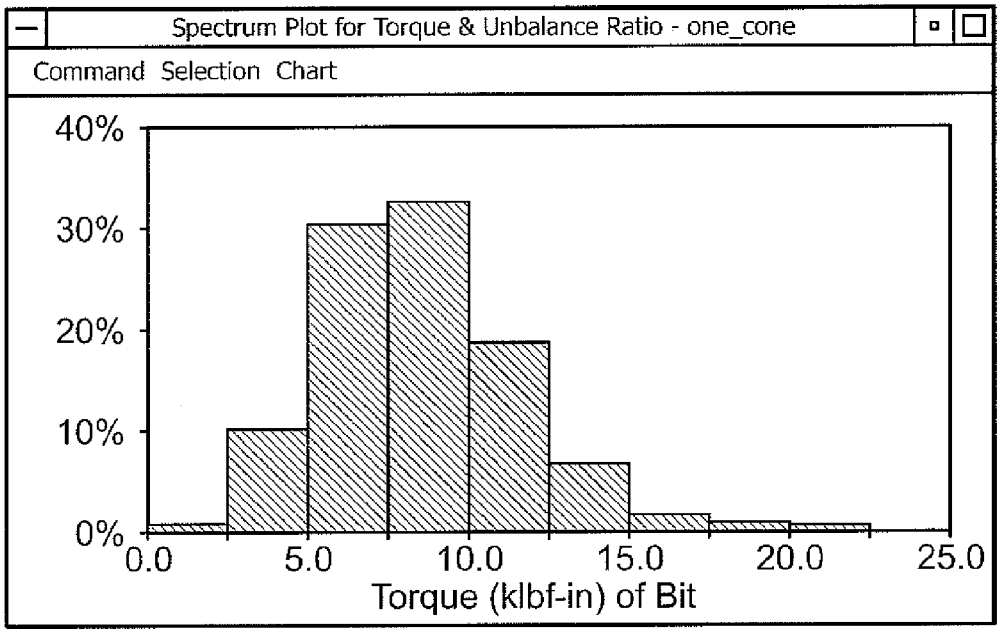
FIG. 22 shows an example of a graphical representation in accordance with an embodiment of the invention.
Figure 23:
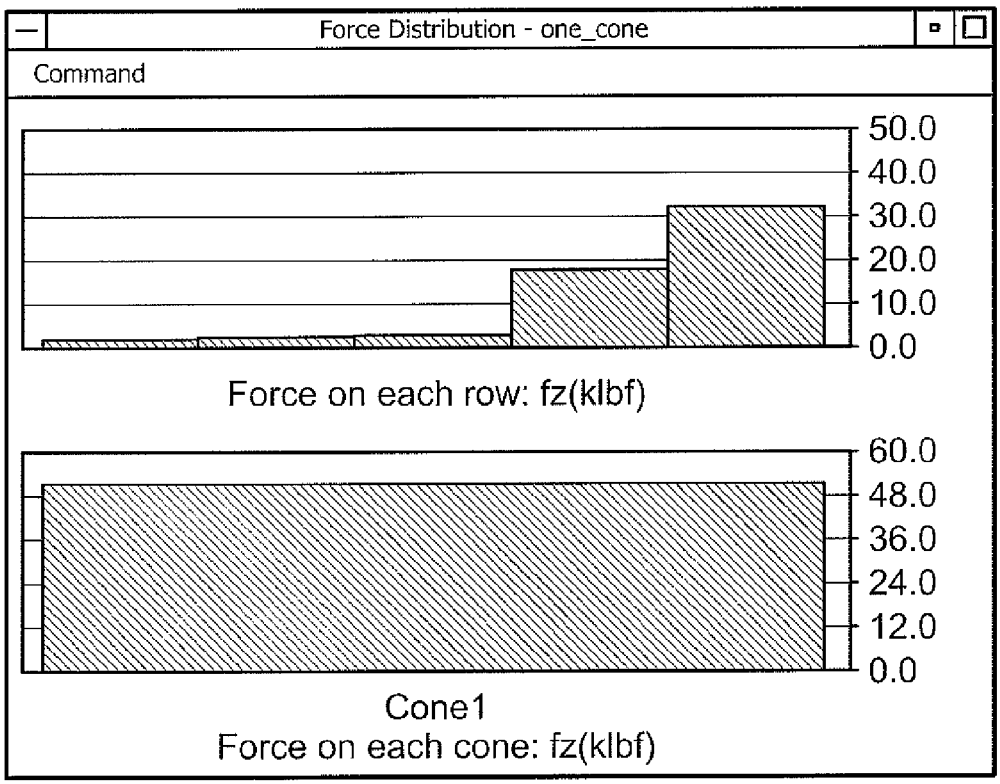
FIG. 23 shows an example of a graphical representation in accordance with an embodiment of the invention.

FIGS. 21-23 illustrate exemplary forms in which the collected data may be displayed to a designer during the analysis phase. In particular, FIG. 21 shows a "Box and Whiskers" plot for torque on the single cone bit. This plot basically provides a graphical representation of the median (indicated by the line inside the box), and then provides information about the range. Those having ordinary skill in the art will appreciate that a number of other mathematical/graphical techniques may be used to display the data accumulated during the simulation phase and that no particular technique is intended to limit the scope of the present invention. For example, FIG. 22 shows a spectrum plot which illustrates the torque acting on each of the various rows of the single cone. FIG. 23 shows the vertical force acting on each of the rows of the single cone, as well as the total vertical force acting on the cone.

Figure 24:
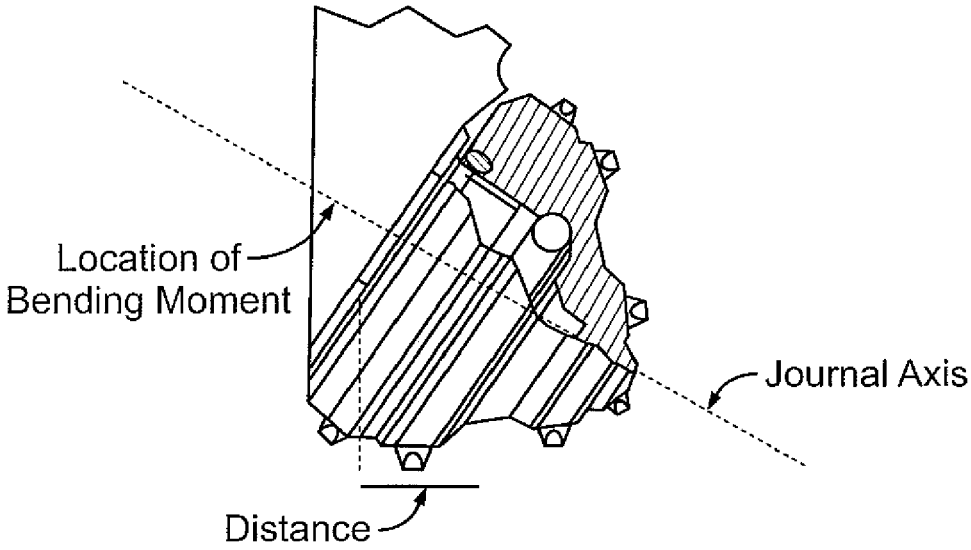
FIG. 24 shows one location of the bending moment in accordance with an embodiment of the invention.
Figure 25:
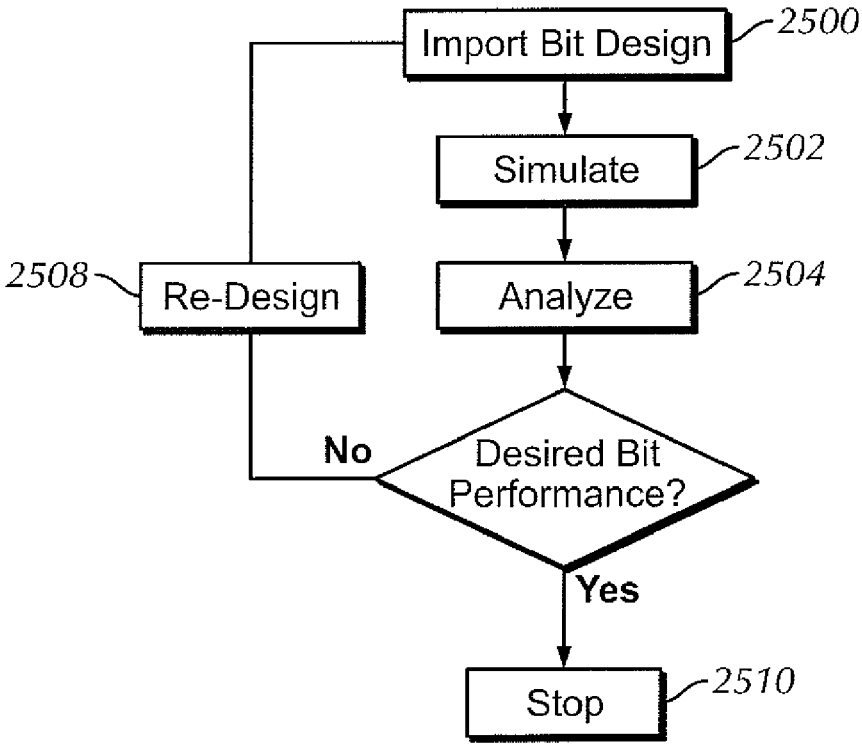
FIG. 25 is a flowchart showing a design methodology in accordance with an embodiment of the present invention.

Returning to the insert, row, and cone parameters listed above (and shown in FIG. 20 in the right hand column), in one embodiment, the bending moment is a measure of the force acting on a leg backface, as illustrated in FIG. 24. In order to determine the bending moment, the $F_z$, $F_r$, and $F_c$ forces acting on an insert are multiplied by the orthogonal distance between the insert and the leg backface to give the insert bending moment components. The insert bending moments are then summed to give the cone bending moment. The maximum, median, and average moment encountered by a cutting element may be displayed to the designer. In other embodiments, the bending moment may be measured at other locations on the bit. Another U.S. Patent Application, filed simultaneously with the present application, entitled "Bending Moment," assigned to the present assignee, and having the same inventor, discloses the bending moment in more detail and is expressly incorporated by reference in its entirety.

Linear wear, as used herein, is a function of the velocity of a cutting element, the stress on the cutting element, the hardness of the formation, and the material used to manufacture the cutting element (e.g., tungsten carbide). In other words, linear wear is determined as follows:

$$\text{Linear Wear} = A \times \frac{v\sigma}{H\varepsilon} \tag{8}$$

where v is the velocity of a given cutting element, σ is the stress encountered by the cutting element, H is the hardness of the formation, ϵ is a material coefficient (determined from the material that the cutting element is made from), and A is a constant.

Information regarding the relative maximum, median, and average wear seen by a given cutting element or row, may be displayed. The wear is a "relative" quantity because the highest wear is set to 1 and all of the other cutting elements are normalized with respect to this value. Another U.S. Patent Application, filed simultaneously with the present application, entitled "Wear Indicator," assigned to the present assignee, and having the same inventor, discloses the wear indicator in more detail and is expressly incorporated by reference in its entirety.

Information regarding the tensile and compressive stress of the inserts may also be displayed to the designer. In order to determine the stress, the cross-sectional area of the insert and the bending moment of inertia are required. The bending moment on the insert places one side of the insert in compressive stress, and the other side of the insert in tensile stress, so the two stresses are related, but not necessarily equivalent. Information regarding the maximum, median, and average tensile and compressive stress for a given cutting element and/or row may be displayed. Another U.S. Patent Application, filed simultaneously with the present application, entitled "Tensile/Compressive Stress," assigned to the present assignee, and having the same inventor, discloses the stresses in more detail and is expressly incorporated by reference in its entirety.

Further, information may be displayed about the maximum, median, and average depth of penetration (i.e., the distance that a given cutting element penetrates into the formation) encountered by a cutting element on a given row, or by the row as a whole. Similarly, the area cut by an individual cutting element or row may be displayed.

In other embodiments, the cone contact force (which is a measure of the force acting on the cone if it should contact the formation), the torque on the cone, the cone speed to bit speed ratio, and the scraping distance for the cutting elements and rows, may be displayed to the designer. Those having ordinary skill in the art will recognize that depending on a particular application a designer may seek to minimize, maximize, control the amplitude, control the frequency, or simply modify any one or all of these various items by modifying either the design of the bit or the drilling parameters.

Thus, in one aspect, the invention provides a method for designing a single cone roller cone bit. In one embodiment, this method includes selecting an initial bit design, calculating the performance of the initial bit design, then adjusting one or more design parameters and repeating the performance calculations until an optimal set of bit design parameters is obtained. In another embodiment, this method can be used to analyze relationships between bit design parameters and drilling performance of a bit. In a third embodiment, the method can be used to design roller cone bits having enhanced drilling characteristics. In particular, the method can be used to analyze row spacing optimization, intra-insert spacing optimization, the bending moment, the penetration depth, cutting area, relative wear, tensile stress, compressive stress, forces acting on the bit (especially in the circumferential, radial, and vertical directions), torque, cone contact force, cone to bit speed ratio, and the scraping area.

Output information that may be considered in identifying bit designs possessing enhanced drilling characteristics or an optimal set of parameters include any one or more than one of the elements listed above. This output information may be in the form of visual representation parameters calculated for the visual representation of selected aspects of drilling performance for each bit design, or the relationship between values of a bit parameter and the drilling performance of a bit. Alternatively, other visual representation parameters may be provided as output as determined by the operator or system designer. Additionally, the visual representation of drilling may be in the form of a visual display on a computer screen. It should be understood that the invention is not limited to these types of visual representations, or the type of display. The means used for visually displaying aspects of simulated drilling is a matter of convenience for the system designer, and is not intended to limit the invention.

As set forth above, the invention can be used as a design tool to simulate and optimize the performance of roller cone bits drilling earth formations. Further the invention enables the analysis of drilling characteristics of proposed bit designs prior to their manufacturing, thus, minimizing the expensive of trial and error designs of bit configurations. Further, the invention permits studying the effect of bit design parameter changes on the drilling characteristics of a bit and can be used to identify bit design which exhibit desired drilling characteristics.

In another aspect, the invention provides a method for optimizing drilling parameters of a roller cone bit, such as, for example, the weight on bit (WOB) and rotational speed of the bit (RPM). In one embodiment, this method includes selecting a bit design, drilling parameters, and earth formation desired to be drilled; calculating the performance of the selected bit drilling the earth formation with the selected drilling parameters; then adjusting one or more drilling parameters and repeating drilling calculations until an optimal set of drilling parameters is obtained. This method can be used to analyze relationships between bit drilling parameters and drilling performance of a bit. This method can also be used to optimize the drilling performance of a selected roller cone bit design.

As described above, the invention can be used as a design tool to simulate and optimize the performance of roller cone bits drilling earth formations. The invention enables the analysis of drilling characteristics of proposed bit designs prior to their manufacturing, thus, minimizing the expensive of trial and error designs of bit configurations. The invention enables the analysis of the effects of adjusting drilling parameters on the drilling performance of a selected bit design. Further, the invention permits studying the effect of bit design parameter changes on the drilling characteristics of a bit and can be used to identify bit design which exhibit desired drilling characteristics. Further, the invention permits the identification an optimal set of drilling parameters for a given bit design. Further, use of the invention leads to more efficient designing and use of bits having enhanced performance characteristics and enhanced drilling performance of selected bits.

In one embodiment of the invention, the designer determines a "stop" point for the design. That is, the individual designer makes a determination as to when a bit is optimized for a given set of conditions. In other embodiments, however, the process may be automated to reach a pre-selected end condition. For example, the number of teeth on the bit could be successively iterated until a five percent increase in ROP is seen.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for designing a single cone roller cone drill bit, comprising:

inputting initial bit design parameters;

modeling at least a portion of a single cone roller cone drill bit based on the initial bit design parameters;

simulating the modeled single cone roller cone drill bit drilling in an earth formation;

adjusting at least one initial bit design parameter based on the modeling and simulating; and graphically displaying at least a portion of the simulating.

2. The method of claim 1, further comprising selecting drilling parameters and an earth formation to be simulated prior to simulating the single cone roller cone drill bit drilling.

3. The method of claim 1, further comprising adjusting a value of at least one design parameter for the single cone roller cone drill bit according to the graphical display and repeating the simulating, displaying and adjusting to change a simulated performance of the single cone roller cone drill bit.

4. The method of claim 1, wherein the graphical display comprises displaying at least one of a bending moment, a penetration depth, cutting area, relative wear, tensile stress, compressive stress, circumferential force, radial force, vertical force, torque on bit, cone contact force, cone to bit speed ratio, and scraping area.

5. The method of claim 1, further comprising analyzing data accumulated during the simulating, wherein the analyzing comprises viewing information associated with at least one of a bending moment, a penetration depth, cutting area, relative wear, tensile stress, compressive stress, circumferential force, radial force, vertical force, torque on bit, cone contact force, cone to bit speed ratio, row spacing, intra-insert spacing, and scraping area.

6. The method of claim 2, wherein the displaying and adjusting is repeated until an optimized single cone roller cone drill bit design is achieved.

7. A method for generating a visual representation of a single cone roller cone bit drilling in earth formations, comprising:

modeling at least a portion of a single cone roller cone drill bit based on initial bit design parameters;

simulating the modeled single cone roller cone drill bit drilling in an earth formation;

calculating visual representation parameters from the simulating; and converting the visual representation parameters into said visual representation.

8. The method of claim 7, wherein the simulating comprises monitoring at least one of a bending moment, a penetration depth, cutting area, relative wear, tensile stress, compressive stress, circumferential force, radial force, vertical force, torque on bit, cone contact force, cone to bit speed ratio, row spacing, intra-insert spacing, and scraping area.

9. A method for optimizing drill performance of a single cone roller cone bit design, comprising:

selecting a single cone roller cone bit design, drilling parameters, and an earth formation desired to be drilled;

modeling the single cone roller cone bit design;

calculating a performance of the selected bit design using the selected drilling parameters on the selected earth formation;

adjusting at least one parameter according to the performance;

repeating the calculating and adjusting until optimized drill performance is achieved, and graphically displaying at least one drill performance parameter.

10. The method of claim 9, further comprising analyzing a relationship between drilling parameters and drill performance.

11. The method of claim 9, wherein the drill performance parameters comprise at least one of a bending moment, a penetration depth, cutting area, relative wear, tensile stress, compressive stress, circumferential force, radial force, vertical force, torque on bit, cone contact force, cone to bit speed ratio, row spacing, intra-insert spacing, and scraping area.

12. A method for designing a single cone roller cone drill bit, comprising:

importing a single cone roller cone bit design into a simulation software;

simulating a performance for the bit design;

analyzing the performance of the bit design; and graphically displaying the simulation.

13. The method of claim 12, further comprising accepting the imported bit design for manufacture.

14. The method of claim 12, further comprising rejecting the imported bit design for manufacture.

15. The method of claim 14, further comprising redesigning the imported bit design.

16. The method of claim 12, wherein the analyzing comprises viewing information associated with at least one of a bending moment, a penetration depth, cutting area, relative wear, tensile stress, compressive stress, circumferential force, radial force, vertical force, torque on bit, cone contact force, cone to bit speed ratio, row spacing, intra-insert spacing, and scraping area.

* * * * *